US005099763A

United States Patent [19]

Coursen et al.

[11] Patent Number: 5,099,763

[45] Date of Patent: Mar. 31, 1992

[54] METHOD OF BLASTING

[75] Inventors: David L. Coursen, Sedona, Ariz.; Rufus E. Flinchum, Christianberg, Va.

[73] Assignee: ETI Explosive Technologies International, Mississauga, Canada

[21] Appl. No.: 714,846

[22] Filed: Jun. 13, 1991

Related U.S. Application Data

[62] Division of Ser. No. 524,375, May 16, 1990, Pat. No. 5,071,496.

[51] Int. Cl.[5] ..... F42G 3/00

[52] U.S. Cl. ..... 102/313; 86/20.15; 149/2; 149/21

[58] Field of Search ..... 102/313; 86/20.15; 149/2, 21

[56] References Cited

U.S. PATENT DOCUMENTS 4,757,764 7/1988 Thureson et al. ..... 102/313
4,864,933 9/1989 Kusov et al. ..... 102/313

*Primary Examiner*—Stephen J. Lechert, Jr.
*Attorney, Agent, or Firm*—Fish & Richardson

[57] ABSTRACT

A blasting agent is disclosed for use in a borehole having a pressure resistant closure. The blasting agent is used in combination with a primary initiating system comprised of a detonator and an initiator for the detonator. The blasting agent is preferably a semi-fluid explosive material having a predetermined sensitivity. The sensitivity is related to the borehole diameter and the initiating system's strength, wherein the blasting agent upon initiation is transformed into explosive products by means of reaction front which consumes substantially all the blasting agent as the reaction front passes through the blasting agent. The reaction front has an average velocity of propagation of beween 200 meters/-second and 1,000 meters/second for at least 30% of the total length of blasting agent located in the borehole. Another aspect of the invention is a method of blasting wherein the average velocity of propagation of the explosive front in the blasting agent is in a range of between 200 m/sec and 1,000 m/sec.

26 Claims, 16 Drawing Sheets

METHOD OF BLASTING

This application is a division of U.S. application Ser. No. 07/524,375, filed May 16, 1990, now U.S. Pat. No. 5,071,496.

BACKGROUND OF THE INVENTION

This invention relates to an explosive composition, and a method of blasting with the explosive composition. In particular, this invention relates to an explosive composition comprised primarily of ammonium nitrate, fuel and a fluid, which is in the form of slurry, water gel, or emulsion explosive and which may be used in the surface mining of coal by cast blasting, the production of armourstone or riprap, free face rock blasting, and explosive stimulation of oil wells, gas wells, water wells and the like.

In the past it has been generally believed in the rock blasting art that for explosives comprised primarily of ammonium nitrate and fuel, higher velocities of propagation yield better blasting results, and it is well established that higher propagation velocities are the result of higher pressures in the chemical reaction zone of an exploding charge. Further, it has been generally believed that there is a minimum propagation velocity for commercial explosives of about 2000 m/s, below which the blasting action is unsatisfactory. Below this threshold, there are additional concerns about whether the reaction will go to completion, and whether, in light of the foregoing uncertainties, the charges in a series of holes would explode in about the same way. All of these concerns are based upon the desire to maximize the amount of useful work done by an explosive charge; incomplete explosions do not so maximize the useful work because of the unutilized energy left over in the unexploded portion or incompletely reacted ingredients. Indeed, such explosions often result in levels of ground vibration that are undesirably high, because the level of ground vibration produced by a charge of a given size increases greatly when its explosion has insufficient strength to break the rock to a free face. Consequently, typical commercial explosives are formulated and used so as to have propagation velocities of up to 3000–7000 m/sec, depending upon the rock involved.

There are many known blasting agent compositions and methods of using the same. Examples of prior patents for oil well stimulation include U.S. Pat. Nos. 3,630,284, 3,174,545 and 3,264,986. Examples of patents disclosing two or more component explosive compositions include U.S. Pat. Nos. 2,732,800, 3,342,132, 3,377,909, 3,462,324, Re Nos. 26,815, 3,474,729. Examples of annular lubricating through long conduits include U.S. Pat. Nos. 4,510,958 and 4,462,429. Various explosive compositions are disclosed in U.S. Pat. Nos. 4,287,010, 4,585,495, 4,619,721 and 4,714,503. An example of stemming a borehole is disclosed in U.S. Pat. No. 4,586,438.

Conventional commercial explosives, such as dynamite, pentolite and ANFO, as normally used, explode by detonation, and are therefore known as high explosives. Essentially, detonation occurs where the reaction zone and its high pressure wave propagate at a velocity greater than the velocity of sound. "High order" detonation occurs where the chemical reaction in the reaction zone goes essentially to completion before lateral expansion occurs. "Low order" detonation occurs where there is lateral expansion of the material in the chemical reaction zone prior to the chemical reaction being substantially completed.

The disadvantage of "high order" detonation, however, is that the level of pressure associated with the pressure wave is typically above the crushing strength of the material being blasted. Consequently, "high order" blasting tends to utilize significant amounts of energy in crushing the rock and producing fines. The energy used to crush the rock is essentially wasted. Furthermore, when such charges are used to stimulate wells, the zone of crushed rock can block the desired extension of gas-pressured fractures out into the formation, can make post-shot cleanout more difficult, and finally can block production of the completed well.

The disadvantage of "low order" detonation is that with a detonation velocity below about 1000 m/sec in commercial blasting agents having a density of 0.85 or greater, it has been noted that the result has been unstable rates of detonation, with incomplete chemical reaction and poor blasting results. Explosives Engineering Vol. 4, No. 1 P.5, May/June 1986 describes the unsatisfactory blasting behaviour of an ANFO explosive that had become wet during loading, and which had an explosive velocity of 623 m/sec. The author suggests that when such behaviour occurs, the explosive efficiency of ANFO suffers greatly. The author teaches how to maintain high velocities by placing cartridges of a more sensitive explosive every few feet within the charge.

Black blasting powder, which has a typical explosive propagation velocity of about 400 m/sec, explodes by a different explosive mechanism, namely, by explosive deflagration. Explosive deflagration is not propagated by a shock wave, but is rather propagated by convective flow of hot gases from ignited grains to the interstices between unignited grains, which causes further ignition of said grains. However, black blasting powder is too low in energy density, too dangerous, too expensive and too difficult to utilize to be a viable modern commercial blasting explosive. Explosive deflagration by convective flow through interstices cannot work in conventional high density blasting agents because they are not sufficiently flammable and because their interstices are either too small or not present at all.

BRIEF SUMMARY OF THE INVENTION

What is desired therefore is an explosive composition which is inexpensive to produce, but at the same time is safe and reliable, and which has a low enough propagation velocity and associated pressure so as to minimize the amount of rock crushing, while at the same time having a high energy density and the capability of imparting energy efficiently into the material being blasted, so as to achieve a superior blasting effect. Such an explosive composition would preferably react completely and reliably, and at a predetermined designated rate.

According to the present invention, there is provided: A blasting agent for use in a bore hole having a pressure resistant closure and for use in combination with an initiating system comprising a detonator, generally provided with a primer or booster or both, and a means for initiating said detonator, said blasting agent being characterized as a semifluid explosive material having a predetermined sensitivity, having regard to said bore hole diameter and said initiating system's strength; and wherein said blasting agent upon initiation is transformed into explosive products by means of a reaction front which consumes substantially all of said blasting agent as said reaction front passes through said blasting agent, wherein said reaction front has an average velocity of propagation of between 200 m/sec and 1000 m/sec for at least 30% of the total length of blasting agent located in said bore hole.

It is to be understood that in this context, the term "detonator" includes a blasting cap and any primers or boosters associated with it, and the size of a detonator means the combined masses of a blasting cap and any such primers or boosters.

BRIEF DESCRIPTION OF THE DRAWINGS

For ease of understanding, reference will now be made to various drawings which illustrate, by way of example only, various preferred embodiments of the present invention.

DETAILED DESCRIPTION OF THE INVENTION

Figures 1A, 1B, 1C, 1D:
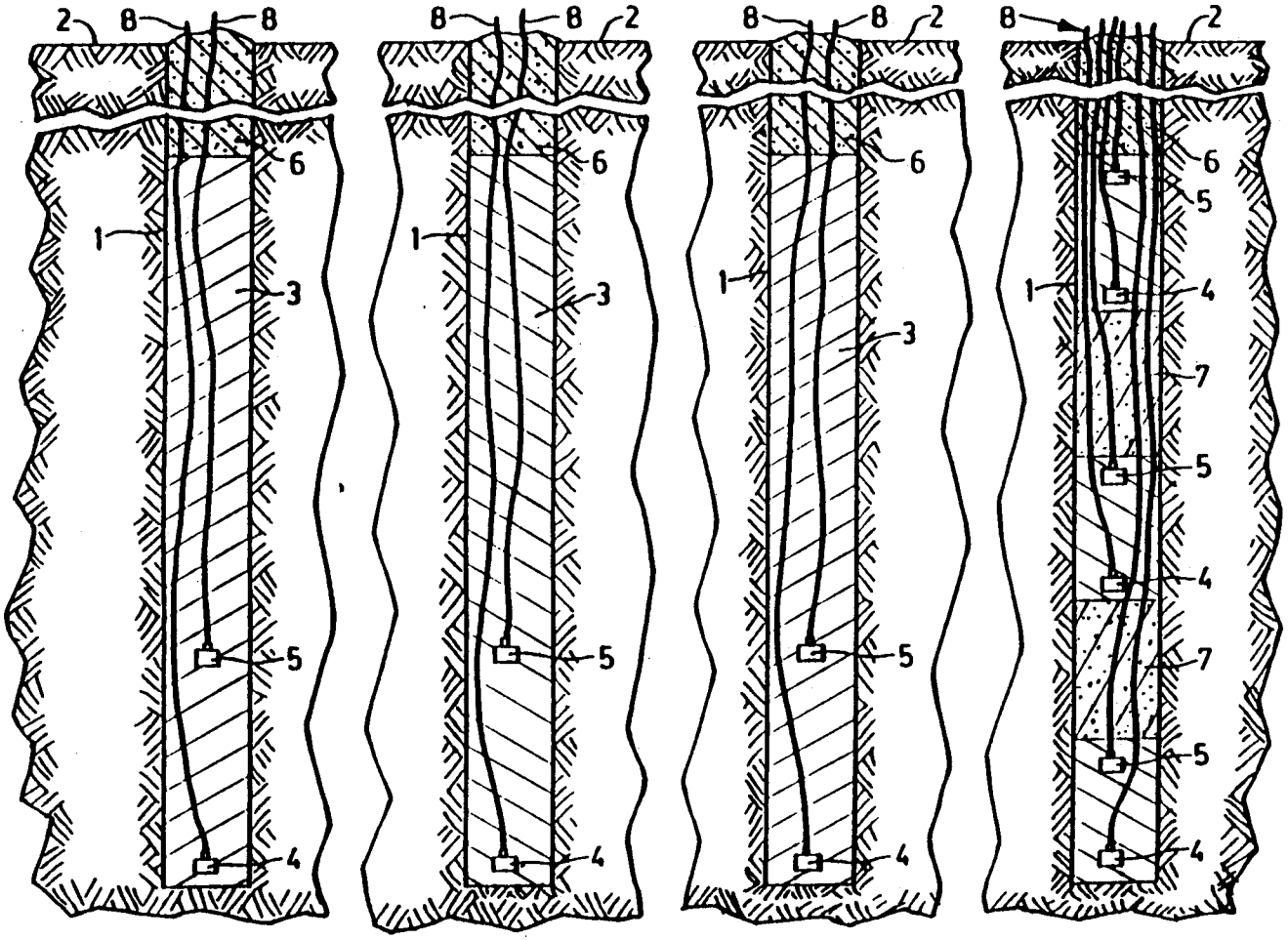
FIG. 1A, B, C, and D are a series of cross sectional views of boreholes loaded with blasting agent according to the present invention.

FIG. 1 shows four boreholes loaded with blasting agent according to the present invention. A geological formation is penetrated by one or more holes 1 drilled into it from the surface 2, where the diameter of the hole is chosen in accordance with the invention as described below. The particular number, depth, orientation, and arrangement of the holes may vary according to the application and are not material to the invention. The holes 1, are loaded with blasting agent 3, with adequate length of hole reserved for containing a seal or stemming 6, just above the blasting agent 1. The stemming is preferably a filling that is capable of holding in place against the explosive pressure created upon detonation of the blasting agent. The stemming 6, may be comprised of aggregate such as pea gravel and may be provided in the same amounts as would be used with conventional explosives charges. In some circumstances, such as well stimulation, the stemming 6, could also be grout or a mixture of ice cubes and pelleted dry ice, or a column of water which is sufficiently long and thus sufficiently massive to confine the unshot portion of the charge during the explosion. In a further alternative, as shown in the right hand hole depicted in FIG. 1, additional intermittent stemming 7, may be used to separate charges in holes containing more than one charge of blasting agent.

Each charge of blasting agent is provided with a delay detonator 4 and a backup detonator 5 in well-separated locations, where the strength of each detonator, which includes the strength of any primer of cap-sensitive explosive in contact with the detonator and any booster of detonating explosive in contact with the primer, is chosen in accordance with the invention as described below, and where both detonators are preferably delay detonators.

A line 8 is also shown which may be a pair of electric leads, a detonating cord, or a shock tube. The line 8 runs from the surface down to each detonator to provide a means of initiating each charge of blasting agent 3. The line or lines 8 may be connected to any number of initiating means, which can be used to provide, in a known manner, desired time intervals between the initiations of the detonators when more than one charge is used. The nature of the means of initiating the detonators and the time intervals used between initiations are conventional and will be apparent to anyone skilled in the art of blasting.

Although FIG. 1 illustrates the use of the invention for a conventional type of surface blast having vertical holes, the invention may utilized one or more holes having any orientation; and though each hole is usually a drill hole for surface mining, it may be a drill hole for underground mining, or a well, or a tunnel for a coyote blast.

Figure 2A:
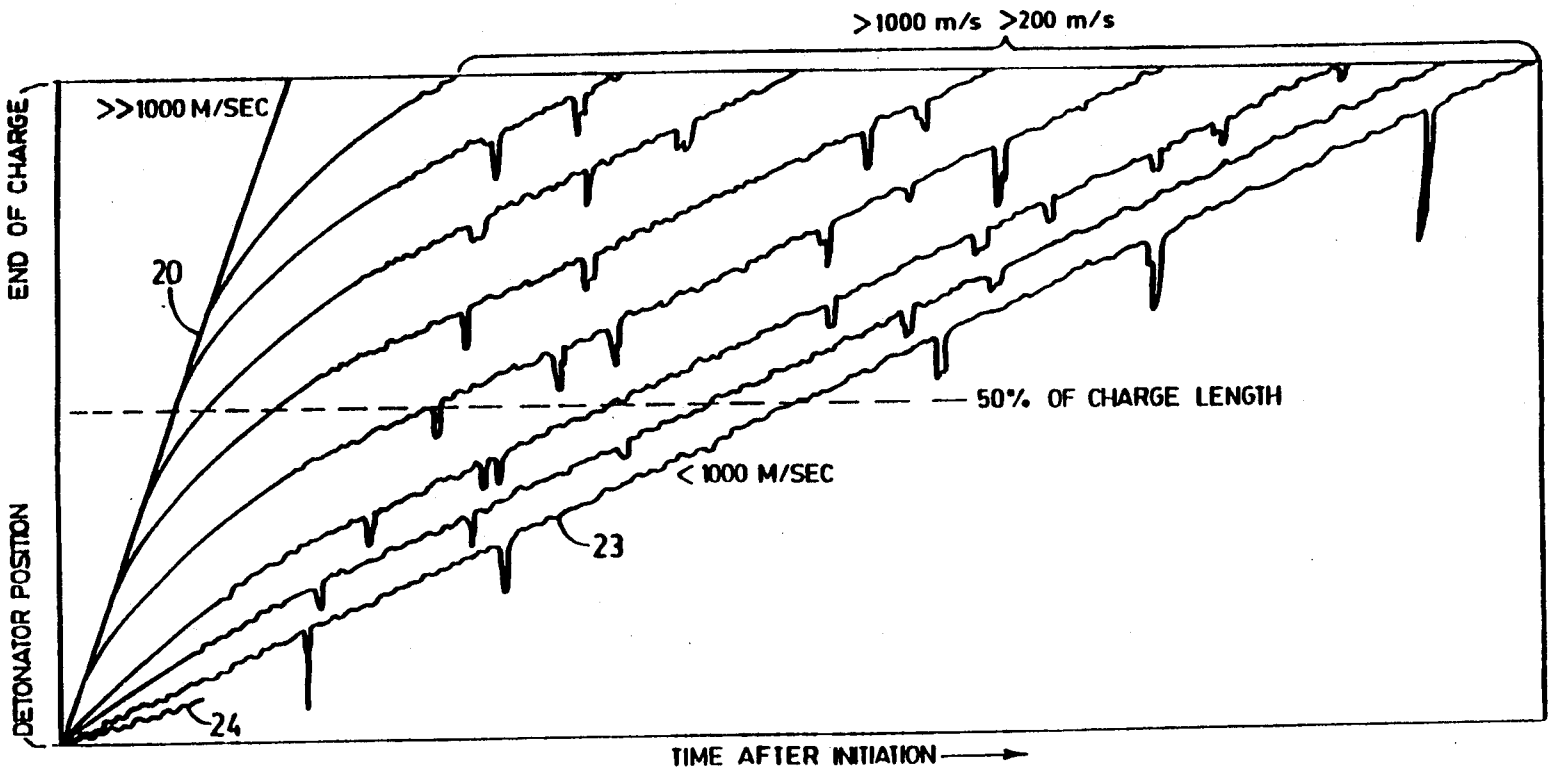
FIG. 2A is a plot of distances travelled by pressure fronts vs. time after initiation for various sized detonators.
Figure 2B:
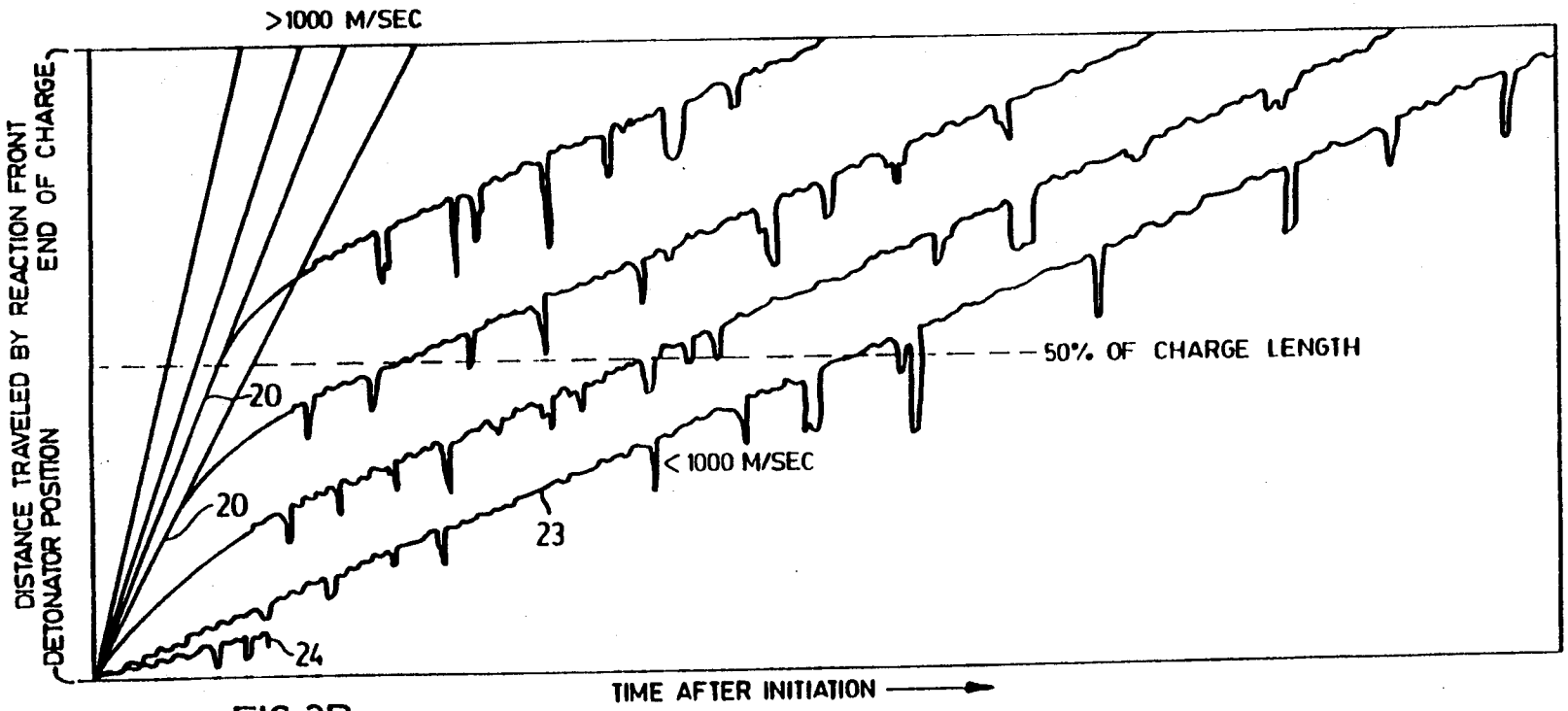
FIG. 2B is a plot of distances travelled by pressure fronts vs. time after initiation for various blasting agent sensitivities.

FIGS. 2A and 2B illustrate plots of the distances travelled by an explosion reaction zone in semifluid blasting agents according to the present invention in sealed boreholes, as a function of time after explosion of the detonator. The slopes of the resulting curves are the velocities of propagation of the explosion fronts. FIG. 2A illustrates typical forms of these plots for detonators of various sizes, at constant composition and borehole diameter. FIG. 2B similarly illustrates such plots for several variations in composition or borehole diameter, or both, at constant detonator size.

Such plots for detonations of conventional high velocity explosives are relatively smooth, as indicated by curves 20. But for the low velocity explosions of this invention such curves may be oscillatory, jagged, or broken as indicated by curves 23. Such lack of continuity and smoothness of such curves can prevent accurate estimation of a velocity of propagation over small distances. But over distances of ten borehole diameters or more, the average velocity of propagation can be estimated with sufficient accuracy to establish the average velocity over such distance. Curve 24 indicates a velocity of propagation in a composition that is unable to sustain detonation, resulting in the charge failing to explode completely.

The blasting agent according to the present invention is preferably a semifluid composition that will detonate when it is formed into a body of sufficiently large diameter and shocked by the detonation of a sufficiently large auxiliary charge or detonator in contact with it. The composition preferably includes a carbonaceous fuel such as petroleum, distillation fractions of petroleum, fuel oil, bitumen, ground gilsonite, hydrocarbon oil, paraffin oil, ground coal, carbon black, starch, wood flour, sucrose, ethylene glycol, ethanol, methanol, formamide or mixtures of them. Preferably the composition has a fluid phase containing dissolved nitrates or perchlorates. The solvent for this phase may contain compounds from the group water, methanol, ethanol, ethylene glycol, propyleneglycol, glycerine, formamide, and urea; and preferably one of its constituents is water. Preferably, the ingredients include ammonium nitrate, undissolved ammonium nitrate being in the form of prills, ground prills, or a mixture of them; one or more ingredients that act as fuels or sensitizers or both and that may include a hydrocarbon oil, metallic fuel, or an organic nitrate or nitro compound; and a gellant, thickener, or emulsifier. The metallic fuel is preferably flake, atomized, ground or foil aluminum, or powdered ferrosilicon. Thickening agents such as starch, from the groups of maize starch, wheat starch, cassava starch, oat starch and rice starch, either with or without purification and including pregelatinized forms may be used. Organic nitrates and nitro compounds that can serve as sensitizers include monomethylammonium nitrate, ethylenediamine dinitrate, ethanolammonium nitrate, hexamine dinitrate, urea nitrate, guanidine nitrate, ethylene glycol mononitrate, 1-nitropropane and 2-nitropropane. Compositions containing little or no void space in a form such as air or gas bubbles, glass or resin microballoons, fly ash, perlite or other encapsulated gas or void space are preferred, as are compositions containing no water insoluble Class A explosives such as PETN, RDX or TNT.

The blasting agent of the present invention may be characterized as a blasting agent that differs from conventional slurry, water gel, emulsion, or blended emulsion/ANFO blasting agents by being less sensitive and having a larger critical diameter in view of the combination of the size of the detonator and diameter of the borehole used. And it is to be understood in the discussion below that for a given type of explosive there is a close relationship between increasing sensitivity and decreasing critical diameter, the one implying the other.

Preferred blasting agents for use in practising the invention are the emulsion blends, which are a mixture of ammonium nitrate prills, optionally first mixed with fuel oil and an emulsion comprising a hydrocarbon oil, which includes some hydrophobic oil, an emulsifier, and an aqueous solution of ammonium nitrate or perchlorate optionally supplemented by other nitrates and perchlorates, where the oil is the external phase of the emulsion, the optional other nitrates or perchlorates are one or more of the sodium, potassium, calcium, magnesium or amine salts of nitric or perchloric acid, and the emulsifier is preferably sorbitan mono-oleate, the sodium or potassium salt of a straight chain organic acid contained 12 to 22 carbon atoms. Of these, oleic, linoleic and stearic acids are preferred. The emulsifier may be formed in situ in the composition by using a fatty acid and sodium or potassium hydroxide as ingredients. These then react to form the salt of a fatty acid. In some cases the thickening agents could be a water soluble or water dispersible polymer that can be cross-linked to form a gel and a crosslinker for that polymer, and where thickening occurs by crosslinking the dissolved or dispersed polymer. Such thickeners include guar gum, polyacrylamide and copolymers of acrylamide and acrylic acid. Suitable crosslinkers include potassium antimony tartrate/potassium dichromate, sodium tetraborate, potassium pyroantimonate and TYZOR ®LA which is generically known as titanium ammonium lactate.

In addition, some particular ways of giving the charge a structure that promotes low-velocity propagation are preferred, as described below. However, before considering in detail the low-velocity propagation according to the present invention, it is useful to review the mechanics of conventional "high order" detonation.

The maximum steady state velocity of detonation and the detonation pressure exhibited by conventional charges of detonating explosives can be closely calculated by means of generally accepted theory. The theory gives the velocity and pressure in terms of the explosives' energy content, the equation of state of the mixture of products that result from its chemical reaction and the requirements that mass, momentum and energy be conserved during the explosion. The charge will in general detonate at a velocity close to the theoretical value when its dimensions and confinement are sufficiently great and detonation is initiated by a detonator that produces a shock of sufficient strength. Under these conditions the detonating velocity and pressure of a conventional blasting agent, confined, for example in a bore hole, are closely approximated by the following expressions:

$$D = 0.256\left[\frac{1+1.3d}{d}\right]P^{\frac{1}{2}}; \text{ and}$$

$$P = 15.6\, N\, M^{\frac{1}{2}}\, Q^{\frac{1}{2}}\, d^2;$$

Where P is the pressure in kilobars on the rear boundary of that part of the chemical reaction zone that supports the shock front; d is the density of the explosive in $g/cm^3$; D is the supersonic detonation velocity in km/sec; N is the number of moles of gaseous detonating products released per gram of explosive; M is the average molecular weight of these gaseous products in grams/mole; and Q is the heat of explosion in cal/gram released by the reaction.

It may be difficult to establish reliably in the abstract a set of predetermined blasting agent sensitivity, detonator size and borehole size conditions which promote low-velocity propagation according to the present invention. Thus it has been found preferable to conduct an initial test, since there are no conventional theoretical models which predict the critical criteria, and if the first set of conditions when tried do not have the balance of conditions required by the invention, i.e. to promote continuous low velocity explosive propagation, the composition of the charges and size of detonator and the borehole diameter may be adjusted in successive steps to obtain the required balance. Whether one, two, or all three of these variables are adjusted in these steps may depend upon imposed limits such as a required chamber diameter or the availability of a particular blasting agent whose composition is to be adjusted as required, or the availability of detonators in only a few sizes.

Starting with some particular compositions of blasting agents, one or more of the following steps may be used to identify the particular parameters which will result in the desired low velocity propagation:

(1) Find the largest detonator that will reliably fail to detonate the charge in a borehole of the diameter to be used;

(2) Find the borehole diameter below which steady state detonation cannot be initiated in the composition being tested;

(3) Find a size of detonator that is smaller than the smallest one that will cause the charge to detonate but larger than the largest one that will fail to make the charge explode completely;

(4) Reduce the proportion of one or more sensitizing ingredient or increase the proportion of one or more desensitizing ingredient so as to make the critical diameter for detonation of the composition, as confined in the borehole, larger than the diameter of the borehole in which it is to be used;

(5) Adjust the composition of the charge so that with the detonator and borehole diameter used, it is too insensitive to detonate at a velocity of 1000 m/sec or more but is still sufficiently sensitive to explode at low velocity; or (6) Prepare the charge so that it is not of uniform composition, but has two or more volume fractions of different compositions distributed throughout it, where one volume fraction has less sensitivity to detonation than another.

It will be appreciated by those skilled in the art that while it may usually be preferable to conduct such test blasting at the site to be blasted, in some circumstances it may be possible to conduct the tests off-site, since in some cases the parameters varied such as composition sensitivity, detonator strength or borehole diameter are not site-specific.

In preparing charges in accordance with Step (6), preferred sensitivities for the two volume fractions are such that for the borehole diameter and detonator used, at least one volume fraction is of sufficient sensitivity that a charge completely composed of it will detonate at a velocity greater than 1000 m/sec; and at least one volume fraction is so phlegmatic that a charge composed completely of it will fail to explode.

Charges having volume fractions of such differing compositions are preferred because the charge as a whole can exhibit the explosibility of the volume fraction having the greater sensitivity, without exhibiting its detonability, which is generally higher than that of the other volume fraction. Such charges can explode at low velocity for a wider range of compositions, borehole diameters, and detonator sizes than can charges of uniform composition, by reason of the synergism obtained by combining the two volume fractions as aforesaid.

In making adjustments in composition, an increase in the amount of desensitizing ingredient or a decrease in the amount of a sensitizing ingredient can be expected to decrease sensitivity to detonation, increase the size of the detonator required to obtain detonation, and increase the critical diameter. An increase in desensitizer content or a decrease in sensitizer content can be expected to also decrease explosibility at low velocity. However, low velocity explosibility can be expected to be unaffected by the content of sensitizers in the form of gas or air bubbles, glass or resin microballoons, fly ash, perlite, or other encapsulated gas or void space, when such sensitizers are present in the amounts usually used in conventional blasting agents. Similarly, a change in the fuel content that increases the heat of combustion can be expected to increase the explosibility at low velocity, but may not affect it if the fuel particles are relatively coarse.

Desensitizing ingredients, whose content may be adjusted as outlined above, are water, ethanol, ethylene glycol, propolyne glycol, glycerine, methanol, formamide, urea or a mixture of them, of which water is preferred; and corresponding sensitizing ingredients are ethylenediamine dinitrate, ethanolammonium nitrate, hexamine dinitrate, urea nitrate, guanidine nitrate, ethylene glycol mononitrate, 1-nitropropane and 2-nitropropane, monomethylammonium nitrate being preferred. But sensitizing ingredients in the form of air, glass or resin microballoons, fly ash, perlite, or other encapsulated gas or void space will generally increase detonability without contributing to low velocity explosibility and therefore compositions that do not contain them are preferred.

The affects of an adjustment in composition, borehole diameter, or detonator size on charge behaviour is found by measuring the velocity of propagation of the reaction in one or more trials with well-confined charges. Subsequent adjustments are made in accordance with the results obtained until the average velocities of propagation are consistently above 200 m/sec but below 1000 m/sec and preferably in the range of 250 to 750 m/sec.

In making adjustments so as to reach conditions under which detonation does not occur but low velocity explosion does, reductions in sensitivity, detonator size, or chamber diameter that are too large may result in failure of the charge to explode at all. If the charge fails to explode, an appropriate adjustment may be an increase in the sensitizer content or volume fraction of the most sensitive volume fraction; or in the detonator size; or in the borehole diameter; or in some combination of them.

FIGS. 3A, 3B, 3C, and 3D illustrate several types of arrangements of volume fractions having greater sensitivity and lesser sensitivity in charges of semifluid blasting agents made in accordance with the invention. In these figures, features 1, 2, 3, 4, 5, 6, and 8 correspond to those in FIG. 1. Semifluid blasting agent 3 is shown in these charges to have volume fractions 9 and 10 where, if 9 represents the volume fraction of greater sensitivity, then 10 represents the volume fraction of lesser sensitivity, and vice versa.

Figures 3A, 3B, 3C, 3D:
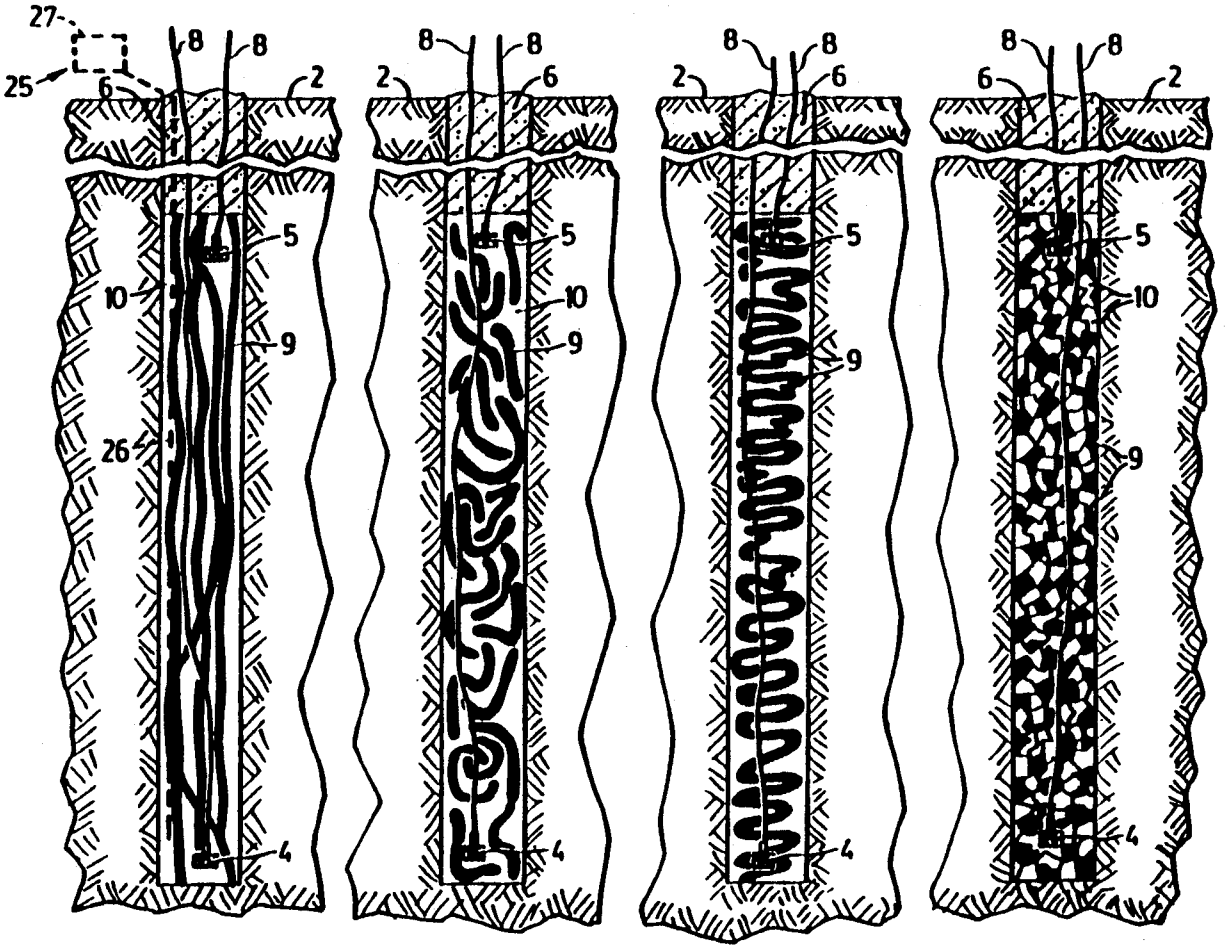
FIGS. 3A, B, C, and D are a series of cross-sectional views of boreholes loaded with blasting agent according to the present invention showing various nonhomogeneous compositions of the blasting agent.

FIGS. 3A, 3B and 3C illustrate the volume fraction 10 surrounding the volume fraction 9. FIG. 3A illustrates the surrounded volume fraction 9 in the form of one or more bodies that run the length of the charge and are more or less parallel to the hole axis. Also shown in ghost outline in FIG. 3A is a measuring device 25, having a section in the borehole 26 which feeds electronic means 27 for measuring the velocity of propagation of explosions. FIG. 3B illustrates the surrounded volume fraction 9 in the form of one or more sinuous or folded bodies that are essentially continuous from one end of the charge to the other. FIG. 3C illustrates the surrounded volume fraction 9 in the form of multiple separate volumes that may have various shapes ranging from flattened to elongated to compact, with various possible bendings or stretchings of the shapes. FIG. 3D illustrates a situation where neither volume fraction surrounds the other because each volume fraction is in the form of a multiplicity of separate bodies, randomly or systematically arranged.

In FIGS. 3A and 3C, both volume fractions 9 and 10 are continuous from one end of the charge to the other. In FIG. 3B, volume fraction 10 is continuous from one end of the charge to the other, but volume fraction 9 is not. In FIG. 3D, neither volume fraction is continuous.

A charge made in accordance with the invention will generally have its entire structure in accordance with one of the structures indicated by FIGS. 1, 3A, 3B, 3C, or 3D, but alternatively may have its structure in accordance with two or more of them from place to place in the charge.

In preferred structures for charges of the invention, the semi-fluid blasting agent has a volume fraction of higher sensitivity and volume fraction of lower sensitivity and the volume fraction of higher sensitivity is continuous from one end of the charge to the other. Therefore, preferred structures are schematically illustrated by FIGS. 3A and 3C; and also, when 10 is the volume fraction of higher sensitivity, by FIG. 3B. Preferably, the volume fraction for greater sensitivity occupies 35–65% of the charge volume and preferably at least one of the volume fractions, in the form in which it is introduced into the hole or introduced into a package that is then loaded into the hole, will have a minor dimension for at least 80% of the volume fraction that is equal to or greater than 5 mm but no greater than half the diameter of the drill hole. If the volume fractions are introduced as separately packaged components, as described below, this is the minor dimension of the flattened package; if the volume fractions are introduced as separately-pumped streams, as described below, this is the minor dimension of the exit aperture of the conduit; and if they are formed by injection of sensitizing or desensitizing agent into a hose, as described below, this the diameter of the core and the thickness of the annulus, respectively. In the latter case, where it may not be possible to determine the minor dimension by simple inspection, it may be determined by putting dye in the injection stream, freezing and fracturing a recovered section of the stream exiting the hose conduit, and measuring the minor dimensions of the dyed and undyed volume fractions displayed on the fractured surface. For any of the several ways of forming charges having volume fractions of greater or lesser sensitivity, dying one or both antecedent compositions in this way provides a general approach to measuring the amount that they are blended, with regard to both their composition and the minimum dimensions of the several volume fractions.

Charges having uniformly low sensitivity throughout may be assembled by loading the chosen composition into the borehole by pumping, pouring, loading unpackaged increments of the charge, or loading increments of the charge into bags or packages of plastic film and then loading the bags or packages into the borehole.

Charges having volume fractions of greater and lesser sensitivity, as described above, may be assembled by various methods.

Assembling a charge having the arrangement of volume fractions show in FIG. 3D requires no special apparatus and in some cases may be preferred for that reason. It may be done by separately packaging increments of the two volume fractions, in packages having the required range of dimensions and then loading these packages into the hole while maintaining the required ratio of volume fractions while this is done. The packages may be loaded individually into the hole or may be first put into larger packages, each larger package containing numbers of intermingled package of both components to give its contents the required ratio of volume fractions. In order to allow the package to fill the entire hole volume, they are preferably slit or opened before or during loading. Or alternatively, the packages are only partially filled, while excluding air, so as to make them limp and deformable. If a volume fraction is in the form of a coherent gel that can be loaded without breaking into pieces, then the charge increments of that volume fraction may be loaded without packaging them.

A charge having a volume fraction of two or more different and separate compositions and therefore having regions with differing sensitivities distributed throughout it may be prepared by simultaneously pumping separate, adjacent streams of each of the several semifluid compositions into a container or into a chamber such as a drill hole in rock, and avoiding subsequent mixing of the pumped, semifluid product. The relative sizes of volume fractions emplaced in this way are proportioned to the relative pumping rates of the several streams.

Figure 4:
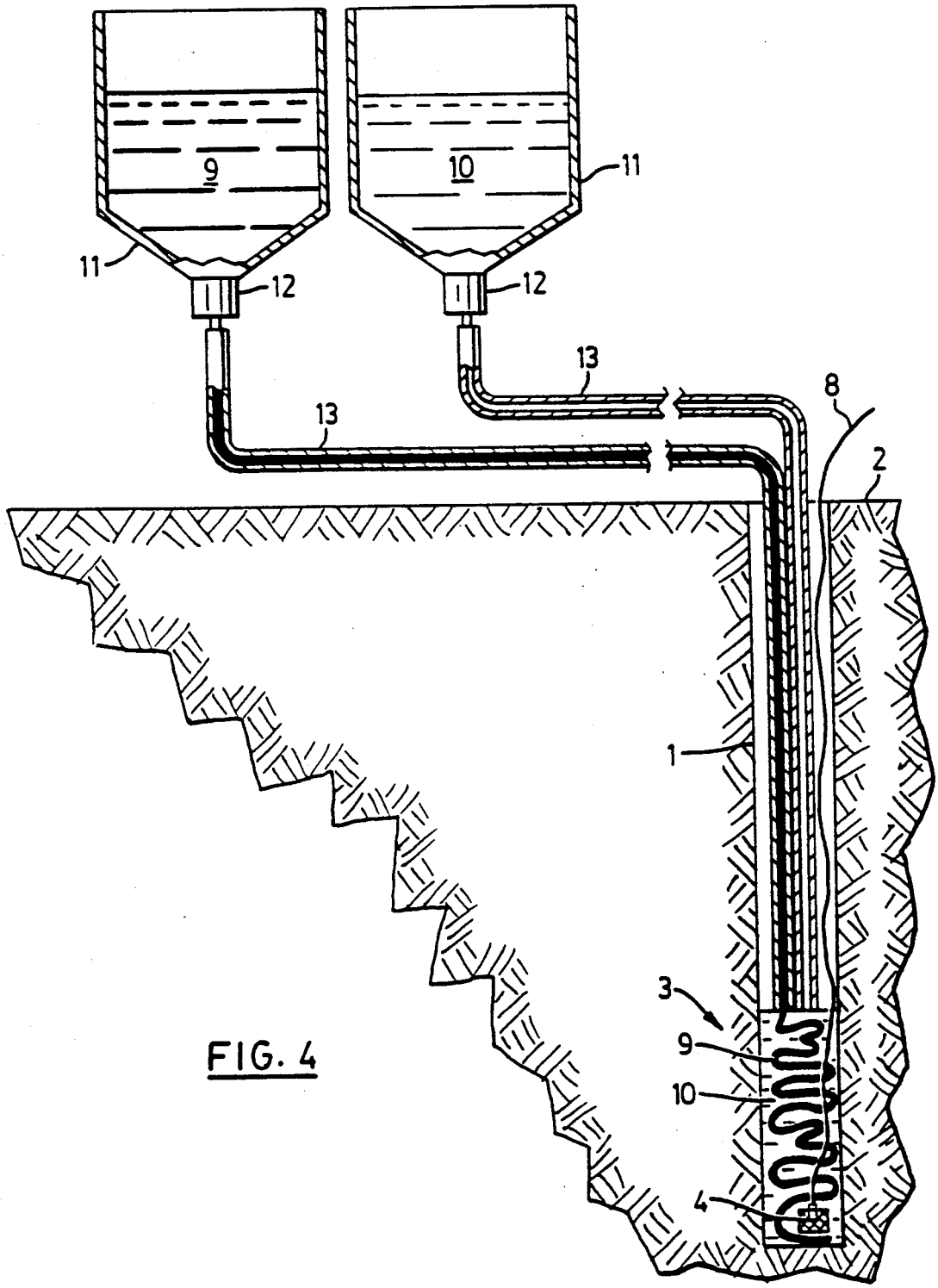
FIG. 4 is a schematic illustration of one method for loading a borehole with blasting agent according to the present invention.

FIG. 4 is a schematic diagram of this method of forming a charge having two different volume fractions, in which two streams are simultaneously pumped into a container or chamber, which in this case is a drill hole, and in which 1, 2, 3 and 4, refer to the same elements as in the previous figures; 11 are tanks or hoppers containing the two differing compositions; 12 are pumps having an adjustable but constant ratio of pumping rates; 13 are conduits leading from the pumps to the top of the charge being pumped into the drill hole, and are preferably hoses; and 9 and 10 are the two differing compositions being pumped into the drill hole with the desired ratio of volume fractions.

In an alternative method of preparing charges having volume fractions of differing sensitivities distributed throughout it, one of the compositions is pumped through a conduit and into a container or chamber such as a drill hole, while at an upstream location a controlled flow of a sensitizing or desensitizing agent is injected into the annulus of the stream in the conduit. Flow of the blasting agent through the conduit produces a desired mixing of the two components in the outer annulus of the stream and no alteration of the composition of the core of the stream, resulting in volume fractions having differing sensitivities.

Figure 5:
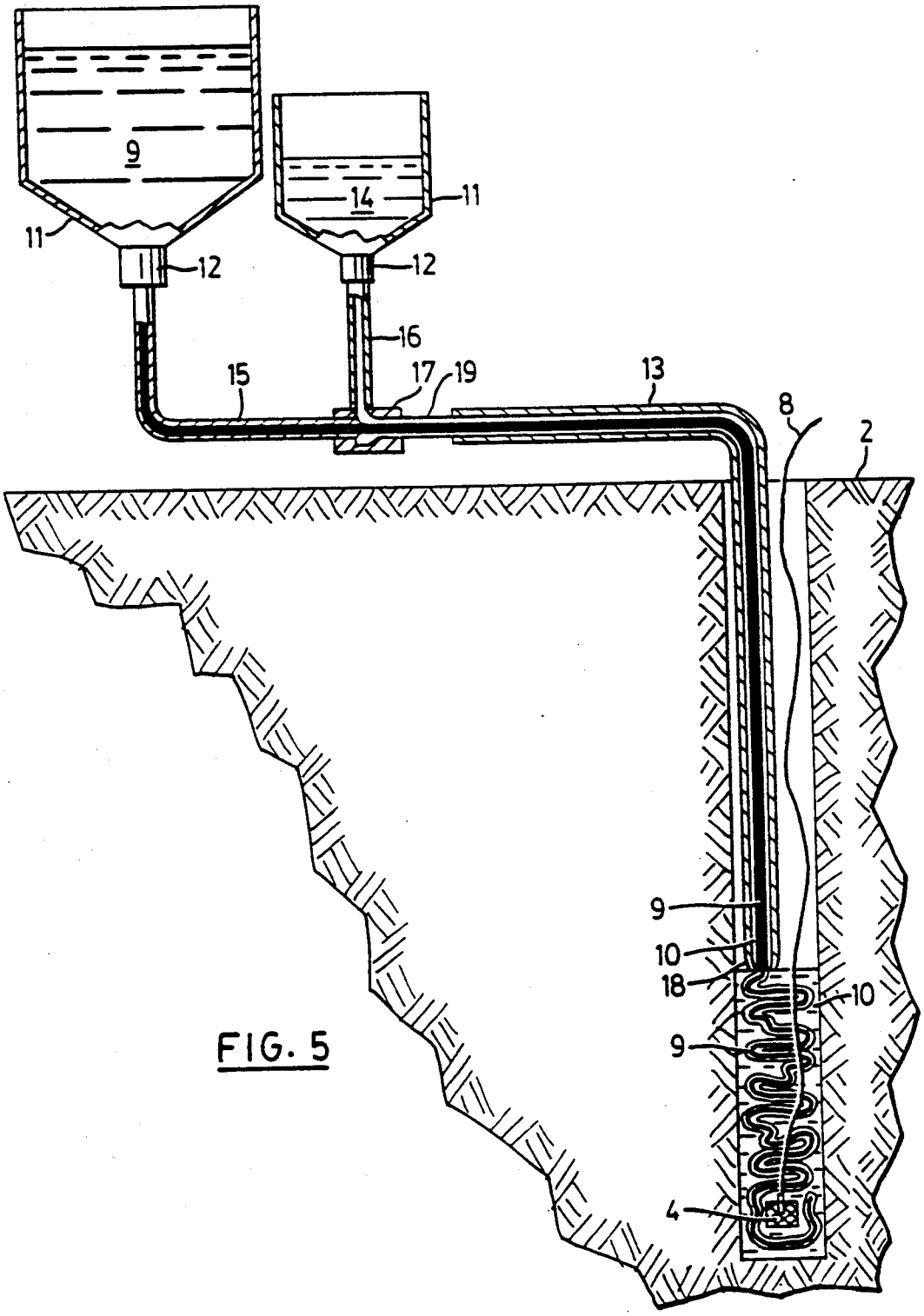
FIG. 5 is a schematic illustration of an alternate method for loading a borehole with a blasting agent according to the present invention.

FIG. 5 is a schematic diagram of this method of forming a charge, where 1, 2, 4, 8, 9 10, 11, 12 and 13 are the same as in the previous figures; 14 is a fluid sensitizing or desensitizing agent; 15 is a conduit through which component 9 flows into the injector 17 along its axis; 16 is a conduit though which agent 14 flows into injector 17: and injector 17 is a device of the type disclosed in U.S. Pat. No. 4,510,958 (Coursen) that injects the agent 17 inzo the entire circumference of the inner walls of the nipple 19 to which the conduit 13 is attached Mixture of agent 14 with the outer annulus of component 9 in conduit 13 results in a stream exiting it that has an annular outer layer of component 10 and a core of component 9. The lubrication resulting from injecting agent 14 into the outer annulus of the stream in conduit 13 may require that the conduit exit 18 have a smaller inside diameter than that of the conduit 13 to prevent the column of explosive in conduit 13 from falling out of it. Preferably, the internal wall of the conduit contains transverse ridges or other projections that facilitate mixing of the agent into the outer annulus of the stream.

When making blasts in accordance with this invention, including test blasts made to adjust sensitivity, detonator size, or hole diameter, the mass, strength and imperviousness of the rock, stemming, or other material enclosing and confining the charge must be sufficient to allow the deflagration of the entire charge to occur under pressure. Release of pressure on the propagation reaction zone can quench the explosive deflagration and reduce the useful work done by the explosion. Such premature release of pressure can result from early movement of the burden or early blowout of stemming which can result from the use cf a burden that is too small or the use of stemming that is of inadequate length or quality. Burdens and stemmings of at least 25 hole diameters are generally adequate for rock blasting, and stemming of 400 hole diameters is generally adequate for oil and gas well stimulation. The stemming may be composed of cement or of an aggregate such as drill cuttings, crushed stone, sand, gravel, or dirt, but is preferably 5 mm to 20 mm crushed stone. In stimulating wells, where the stemming may be required to protect the casing or to provide re-entry without drilling out the old stemming, the stemming may be composed of such aggregate but may also be composed of cement, ice, dry ice, or a mixture of ice and dry ice.

In one preferred set of conditions for practicing the invention the charge has volume fractions of higher and lower sensitivity and is formed by the method illustrated in FIG. 5 where:

(1) a blasting agent having the composition of the more sensitive volume fraction is pumped into a conduit that can be extended to have its exit be at the bottom of the borehole;

(2) the preferred composition of this blasting agent which includes the preferred operating ranges of the components of the composition is 40.0%±5.0% prilled ammonium nitrate mixed with 60.0%±5.0% of an emulsion, where the emulsion has an oil-rich external phase and a water-rich internal phase and contains 16.6%±1.7% water, 70.8%±7.1% dissolved ammonium nitrate, 7.7%±0.1% No. 2 fuel oil, 3.8%±0.4% oleic acid, and 1.1%±0.1% sodium hydroxide, to give an overall composition that is 12.6%±2.3% water, 80.9%±8.1% ammonium nitrate, 4.5%±0.4% No. 2 fuel oil, 2.2%±0.2% oleic aid, and 0.7%±0.1% sodium hydroxide; and it will be appreciated by those skilled in these types of compositions that changes in one or more of these percentages within the indicated ranges can be compensated for by changes in the percentages of one or more of the other ingredients by amounts that may extend outside the indicated range but still yield a blasting agent having the desired velocity of explosive front propagation and thus still fall within the instant invention;

(3) the agent injected into the conduit carrying the stream of blasting agent is water;

(4) the agent is injected into the conduit at a point 15 to 70 m and preferably 25 m to 35 m from the output end of the conduit and is injected onto the entire circumference of the inner wall of the conduit;

(5) injection of the agent onto the entire circumference of the inner wall of the conduit is achieved by injecting it through a device of the type disclosed in U.S. Pat. No. 4,510,958 (Coursen);

(6) the mass rate of water injection through said device is 0.5% to 5% of the mass rate of flow of blasting agent through the conduit;

(7) 15 m to 70 m and preferably about 25 m to 35 m of the conduit has an inside diameter of 15 mm to 75 mm and has an inner surface that is contoured with circumferential or spiral ridges that promote mixing of the injected water with the outer annulus of the stream of blasting agent; and the conduit is preferably in the form of a hose having spiral ridges with a relief of 1%-5% of the inside diameter of the hose and a spacing of 5%-25% of the inside diameter of the hose.

(8) the core of the stream of blasting agent exiting the hose has the same water content as it had before being pumped, and has an outer annulus of increased water content, the outer annulus being the less sensitive volume fraction;

(9) the stream of blasting agent may be pumped into bags which are subsequently loaded into a borehole having a diameter of 25 mm to 325 mm, drilled into rock, but is preferably pumped directly into such a borehole, with the hose exit maintained in contact with the rising top of the charge in the hole, in order to prevent water in the hole from mixing with the charge;

(10) the detonator used is a delay blasting cap inserted into a 454 g charge of detonating explosive, where this charge is pentolite or a cap-sensitive semifluid aqueous composition;

(11) two detonators may be used in each charge to increase reliability, but the detonators are placed in widely-separated locations to avoid sympathetic detonation of one by the other, which would double the effective size of the detonator and possibly cause the explosion to propagate at a velocity greater than 1000 m/sec;

(12) several charges according to the present invention, each provided with detonators and separated by beds of aggregate, may be loaded into each hole;

(13) optionally, conventional detonating charges rather than charges of the invention may be placed in some positions of a multi-charge blast where the rock is particularly massive and tends to yield undesirably large fragments unless shattered;

(14) the loaded holes are stemmed with at least 3.5 m of gravel or 5mm-20 mm crushed stone;

(15) the burdens and spacings for the holes are generally larger than those used in conventional blasts with ANFO in holes of the same diameter;

(16) owing to the lower levels of vibration that charges of the invention generally produce in situations where vibration levels must be controlled, the size of charges exploded at a given time or the number of holes in a blast may be increased over those used with conventional detonating explosives;

(17) the initiation system used may be the same as that used in conventional blasting with detonating explosives.

In general, measures taken to reduce the sensitivity of blasting agents also have the effect of reducing the cost of their ingredients. Therefore ingredient cost will generally be lower for charges of the invention than for similar compositions that detonate with velocities greater than 1000 m/sec.

The preferred compositions according to the present invention are predicted to have the energy density and cost of typical modern blasting agents but with superior blasting performance, and often with improved safety properties resulting from the use of compositions having reduced sensitivity and containing no sensitizers in the form of free or encapsulated gas bubbles. Further, the ratio of the mass of rock blasted to the mass of explosive used for blasts made according to the present invention can be equal to or greater than that for conventional blasts of high order exploding ANFO, and the mass of rock blasted per drill hole can be substantially greater, owing to the higher density of the blasting charge according to the present invention compared to that of ANFO.

EXAMPLE 1

A 12-hole quarry blast made in accordance with the invention, and a comparative 12-hole conventional quarry blast were made side-by-side at separate times.

For both blasts, the holes were 160 mm in diameter, drilled 18.3 m into the andesite of the quarry, and inclined 15° from the vertical toward the base of the quarry face, which was 16.2 m high. For both blasts the holes were in a staggered array having two rows of six holes each. The ratios of hole burdens to hole spacings were both 1.17. The ratios of burden to length of stemming were both 1.40. And the ratios of rock mass to explosives mass were both 2.72 metric tons of rock per kg of explosive. But although the amounts of drilling required by both blasts were equal, the blast made according to the invention produced 1.42 times the amount of broken rock owing to the larger mass of higher density explosive that could be loaded into the drill holes, and the larger burdens and spacings that were used to maintain the same ratio of mass of rock to mass of explosive.

The first hole of the front row and the last hole of the back row for both blasts were loaded with two columns of explosive separated by a deck of crushed stone. All other holes were loaded with a single column of explosives.

For both blasts, the detonator for each charge was a delay detonator inserted into a 0.454 kg detonating charge of cast pentolite. For both blasts the charges were initiated in the same order and with the same timing, the seven charges of each row being initiated at 17 ms intervals, with the first charge of the back row being initiated 119 ms after the bottom charge in the first hole of the front row.

All holes had identical toe loads of a conventional detonating explosive of the water gel type, emplaced below the detonators.

The rest of the explosive charge in the blast made in accordance with the invention was a blend of ammonium nitrate prills and emulsion made in accordance with the invention and having a less sensitive and a more sensitive volume fraction, and a density of 1.32; and for the conventional blast was 94% ammonium nitrate mixed with 6% fuel oil (ANFO), to give a density of 0.85.

The explosive charges made in accordance with the invention had a more sensitive volume fraction composed of 40% ammonium nitrate prills mixed with 60% of an emulsion having the following composition:

| Ingredient | Percent |
|---|---|
| Water | 16.66 |
| Ammonium Nitrate (dissolved) | 70.89 |
| No. 1 Fuel Oil | 7.59 |
| Oleic Acid | 3.80 |
| Sodium Hydroxide | 1.06 |

To form the less sensitive volume fraction, this composition was pumped through an injector of the type described in U.S. Pat. No. 4,510,958 and thence through a 30 m length of hose having an inside diameter of approximately 50 mm and a helical ridge on its internal surface, the ridge resulting from helical wire reinforcement in the wall of the hose. The ridge had a relief of 1.5 mm and a pitch of 7.5 mm. Additional water, amounting to 3% by weight of the prill/emulsion blend being pumped through the injector, was simultaneously pumped through the side of the injector and thence onto the circumference of the stream of prill/emulsion blend flowing through the injector. Flow of this stream through the hose mixed the injected water into the outer annulus of the stream. The stream exiting the hose therefore comprised a core of the unaltered prill/emulsion blend surrounded by a layer approximately 5 mm thick that contained the injected additional water. As result of its higher water content this layer had a lower sensitivity than the core. The layer and the core therefore were the volume fractions of lower and higher sensitivity.

Charges of this composition were loaded into the boreholes and up past the detonators by lowering the hose nozzle to the bottom of the hole and maintaining contact between the nozzle and the top of the charge as the charge was pumped into the hole. The resulting charge was of the type illustrated in FIG. 3C.

Prior to loading the holes, they were instrumented so as to obtain an essentially continuous recording of the position of the explosion front as a function of time, over the entire length of the part of the charge that extended above the detonator. With the instrumentation used, rapidly pulsed radar signals were transmitted down crushable coaxial cable imbedded in the charge, to reflect back from regions where the cable was distorted by the pressure front of the explosion. The position of the front and its velocity were thereby determined as a function of time.

As will be appreciated by those skilled in the art, other forms of velocity measurement could also be used. For example, a resistance wire and an adjacent conductor could be placed along the charge in lines parallel to the direction of propagation of the explosion. They would preferably span a distance of at least 10 charge diameters, with the wires touching or inside of the explosive charge. The detonator would be placed in the charge beyond the wires. Then, as resistance wire is shortened by the explosion front, its resistance will change. Measurement of its resistance over time will yield a continuous record of the position of the explosive front over time, and therefore its velocity at any given position.

Another alternative would be to use two or more optic fibers, each with one end at a known position inside or adjacent to the charge and with the other end coupled to electronic circuitry outside the charge. The detonator would be placed beyond the fibers. Each fiber end as the explosion arrives is illuminated. Each fiber carries the pulse of light to the electronic circuitry which detects it and records the arrival time. Thus, the position of the explosion front over time can be measured.

Figure 6A:
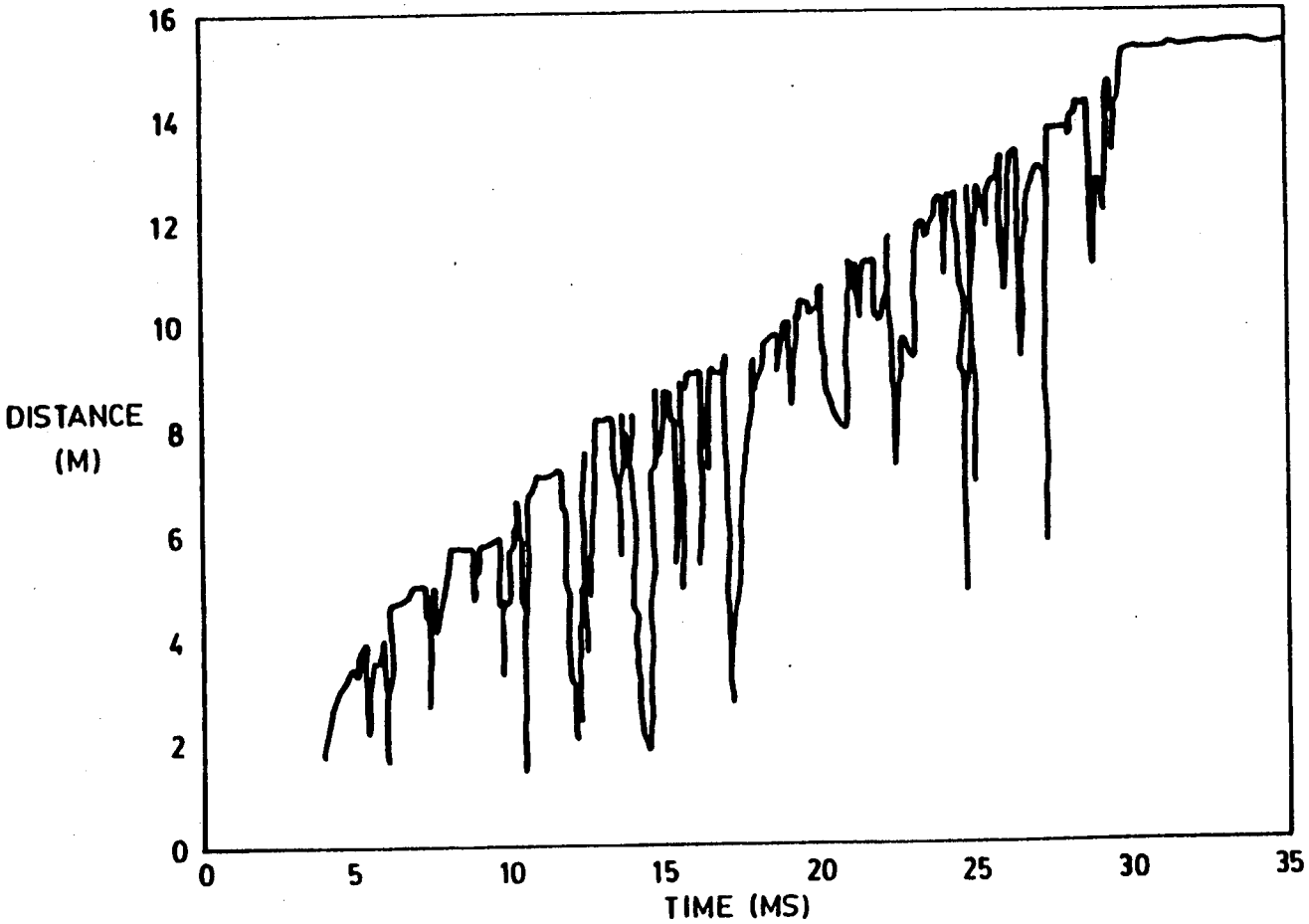
FIG. 6A is a plot of the location of the pressure front vs. time for a first blasting agent according to the present invention, which was initiated in accordance with the teachings of the present invention.
Figure 6B:
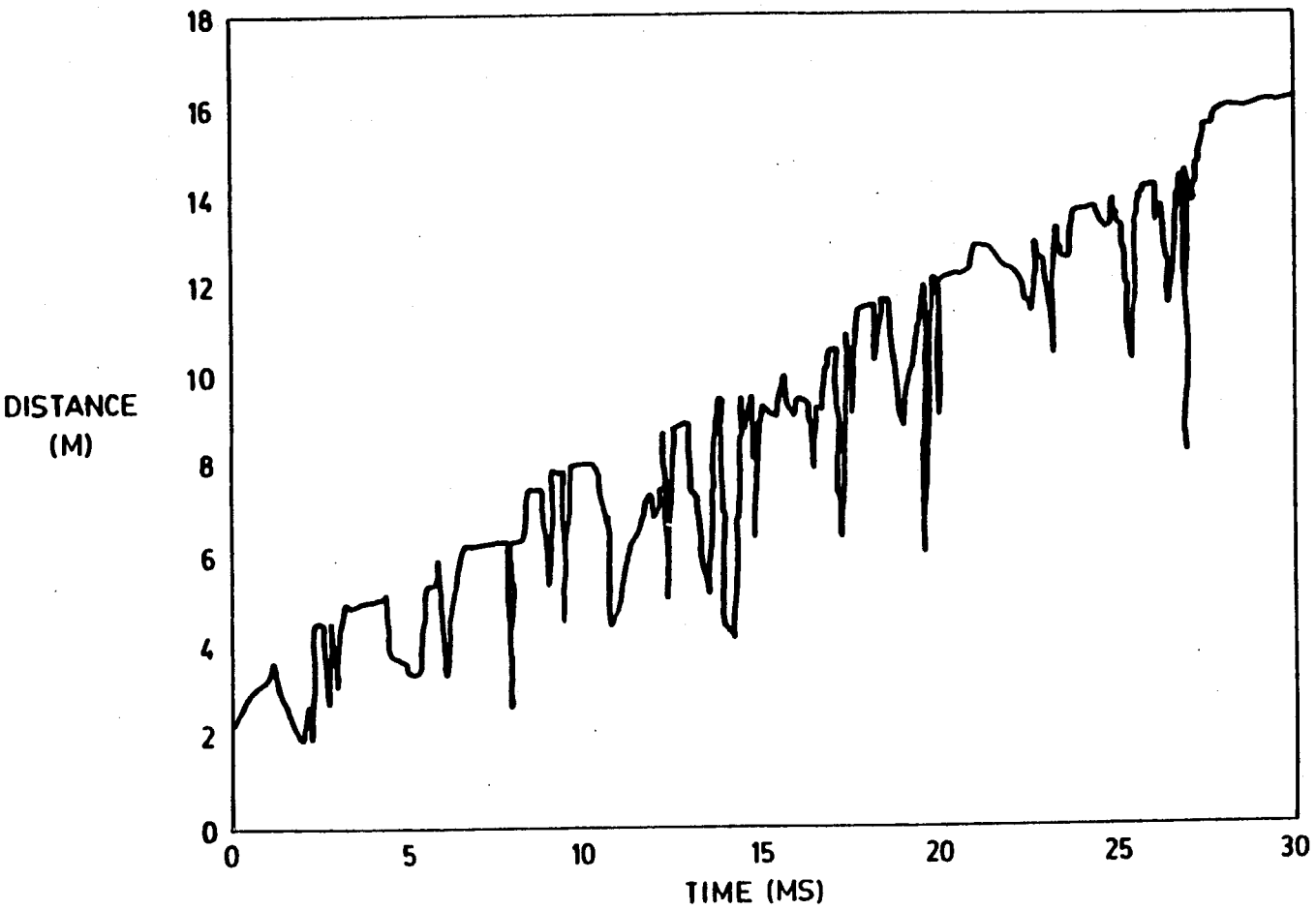
FIG. 6B is a plot of the location of the pressure front vs. time for a second blasting agent according to the present invention, which was initiated in accordance with the teachings of the present invention.

FIGS. 6A and 6B display computer-generated plots of the radar data from two of the charges of the invention, in the blast described above. The slopes of the curves are the velocities of propagation. The velocities are obscured over short time intervals by noise due to the characteristic oscillations in the explosion process, but are nevertheless quite uniform over the lengths of the charges as a whole. These velocities were 429±22 m/sec for the measurements made in this blast.

Figure 6C:
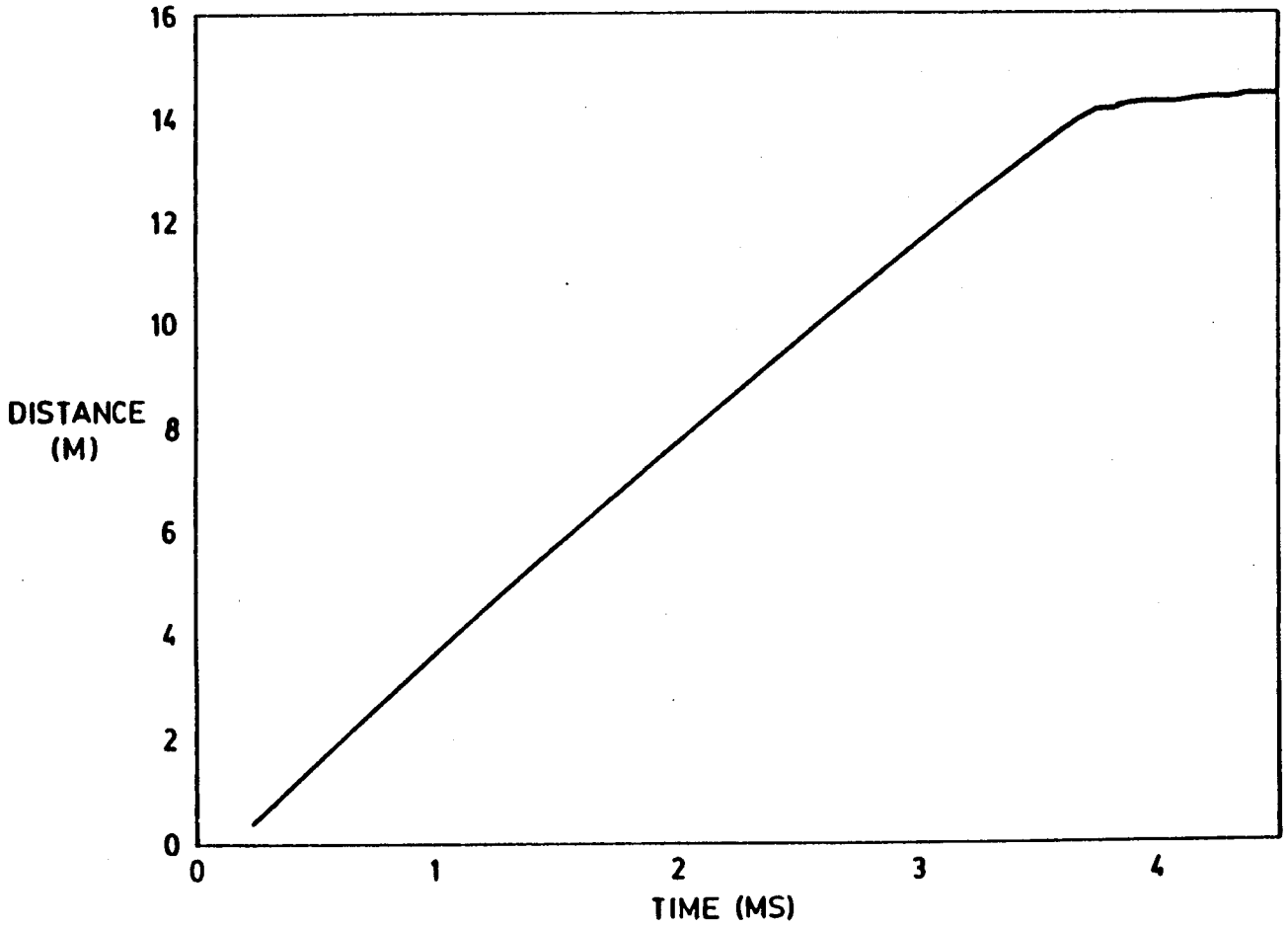
FIG. 6C is a plot similar to plots 6A and 6B, but for the detonation of a conventional charge of Ammonium Nitrate/Fuel Oil (ANFO).
Figure 6D:
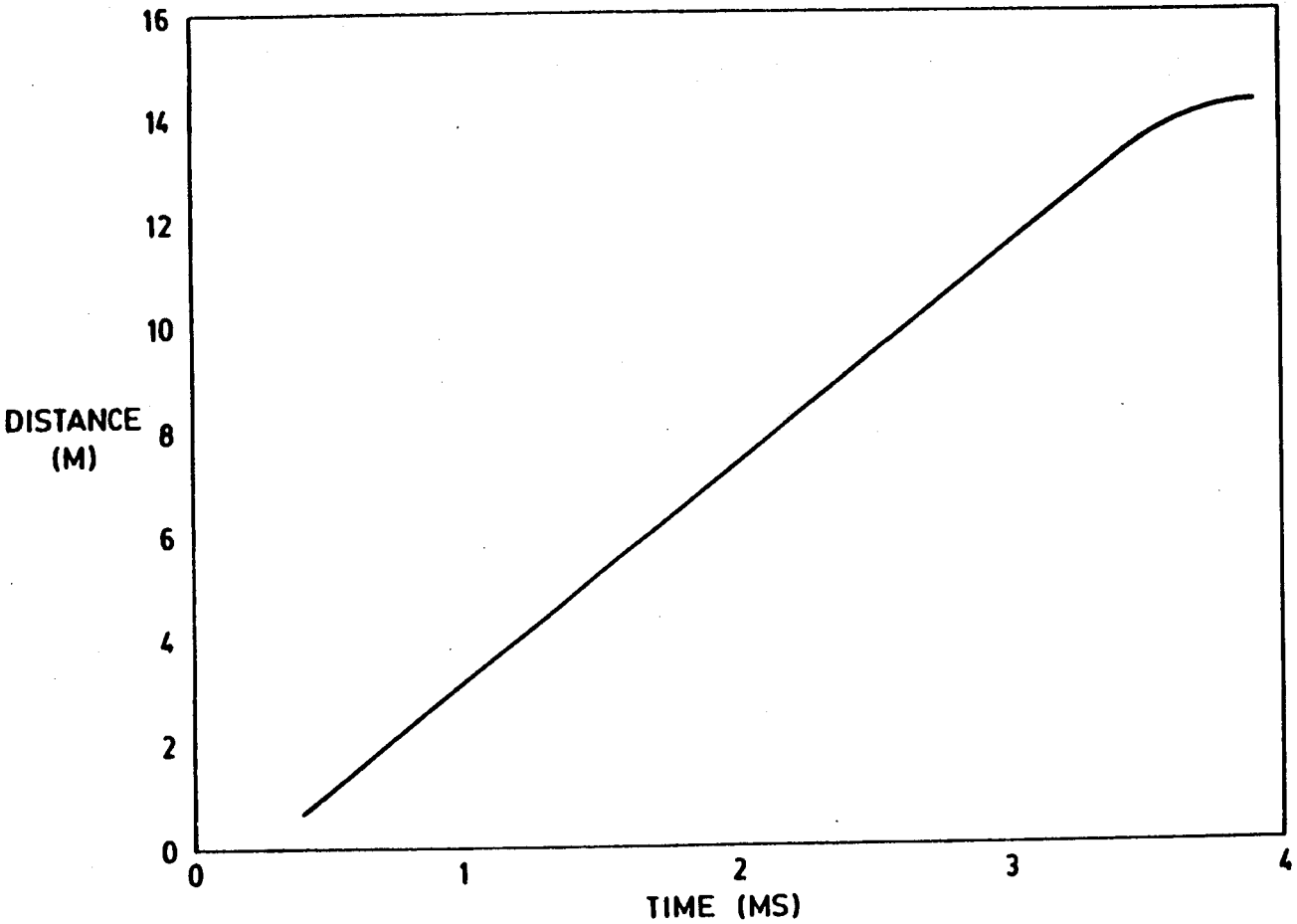
FIG. 6D is a plot similar to 6C for the detonation of a second conventional charge of ANFO.

FIGS. 6C and 6D show corresponding plots of the radar data from two of the ANFO charges in the conventional quarry blast. In this case, slopes of the curves are equal to velocities of detonation and no appreciable noise is present on the plots. The measured velocities of detonation for all the measurements obtained in the 12-hole ANFO blast were 4290±60 m/sec.

Water in excess of 3% was injected during the loading of the top charge in the first hole, which was intended to be a charge of the invention. Video recording of the blast showed orange fumes from this hole, which typically is an indication of incomplete reaction. Velocity measurements on this charge showed that the explosion failed to propagate up the entire explosive column. This charge therefore was an example of a charge for which the composition or amount of the less sensitive volume fraction was outside the claimed limits for this particular combination of hole diameter, size of detonator used, and composition of the more sensitive volume fraction.

Figure 7:
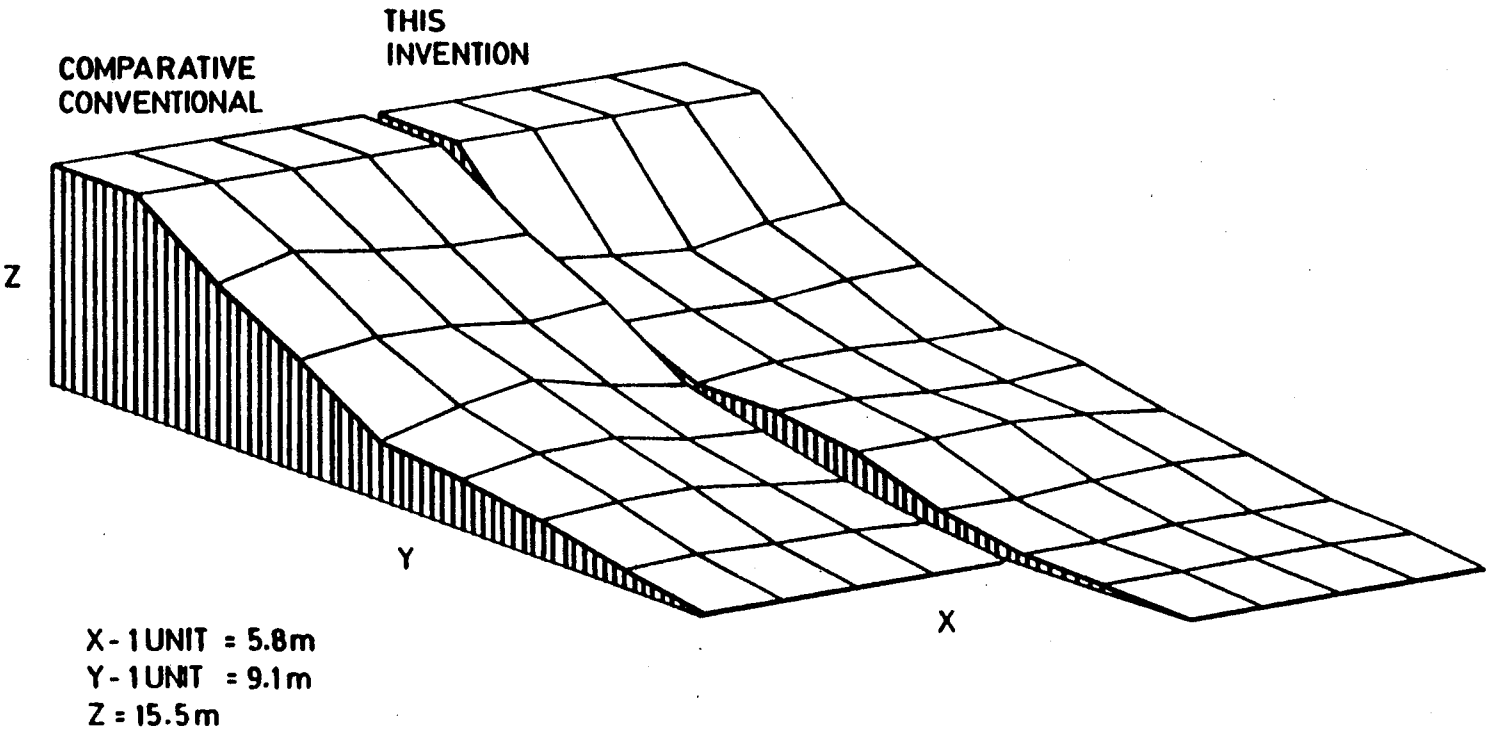
FIG. 7 is a scale drawing of the surveyed shapes of two masses of broken rock produced by two adjacent 12-holes blasts, one made with blasting agent according to the present invention and including the charges that gave the recordings shown in FIGS. 6A and 6B; and one made with conventional ANFO charges, including the charges that gave the recordings shown in FIGS. 6C and 6D.

FIG. 7 is a scale drawing of the surveyed shapes of the two masses broken rock produced by the two 12-hole blasts. It shows that the rock was thrown farther in the blast made in accordance with the invention than in the conventional blast made with ANFO.

Figure 8A:
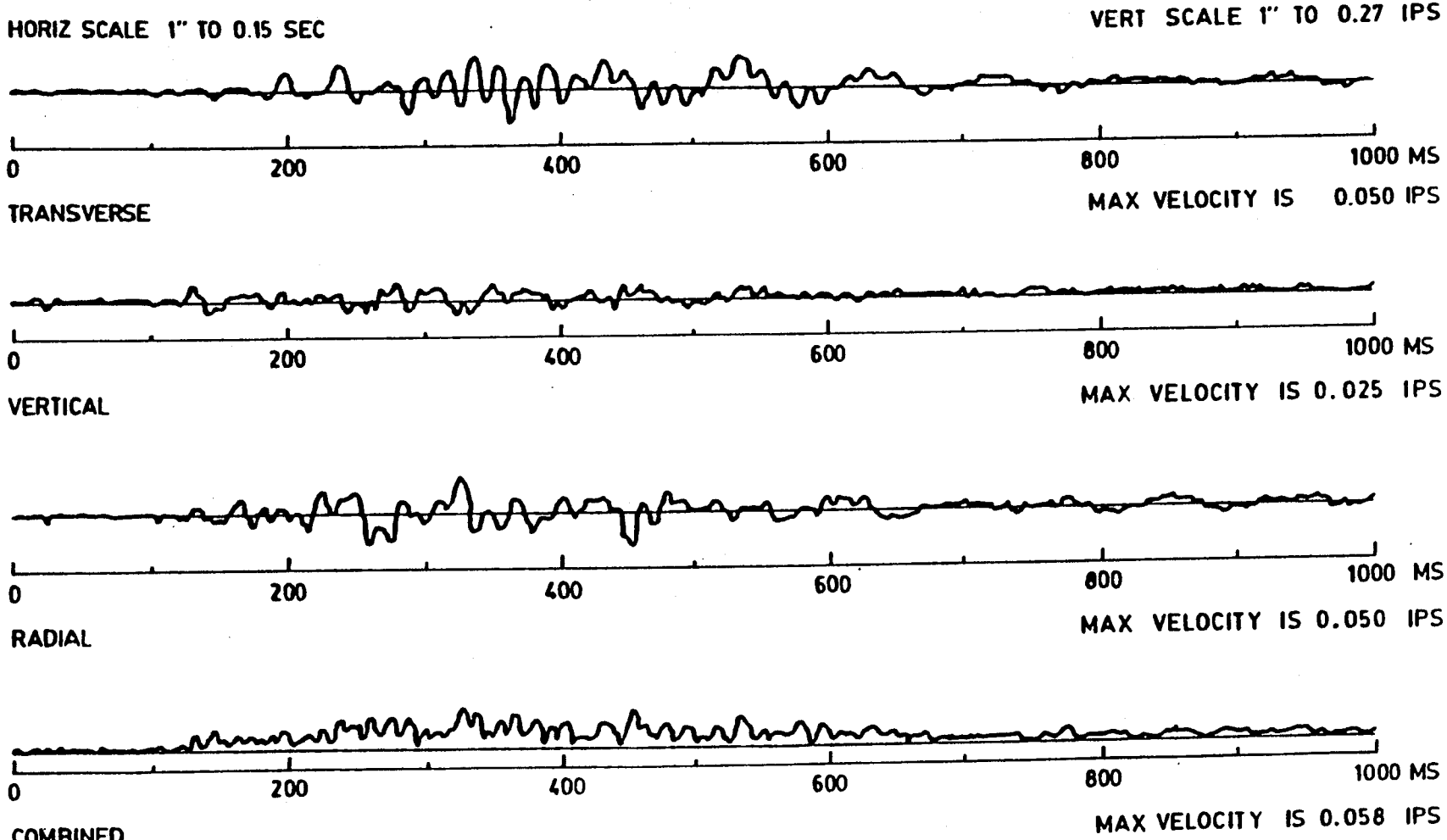
FIG. 8A is a plot of the ground vibration produced by a 12 borehole blast of blasting agent according to the present invention.
Figure 8B:
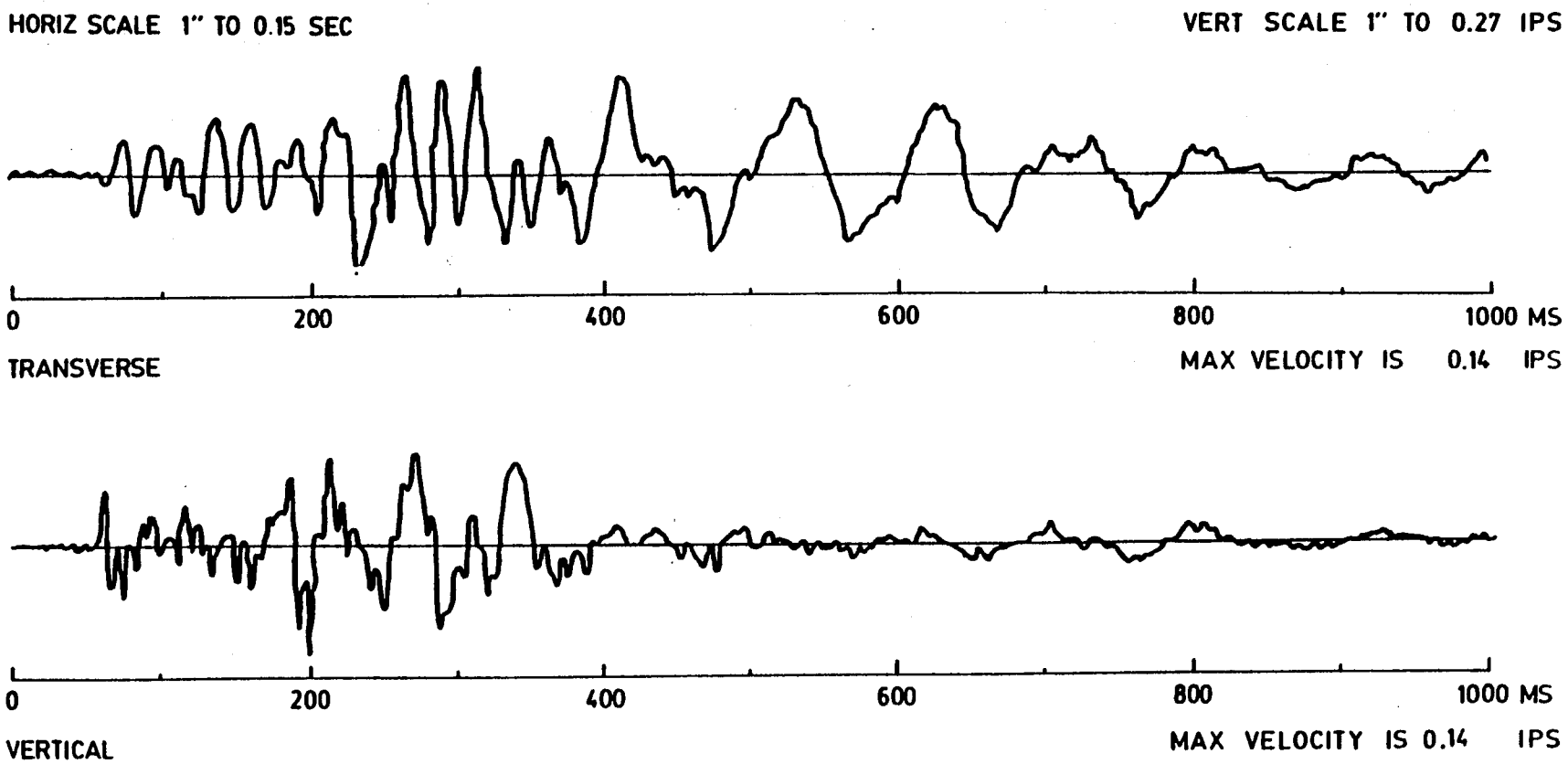
FIG. 8B is a plot of the ground vibration produced at the same location by a 12 bore hole blast made with conventional ANFO at an adjacent location to the blast plotted in FIG. 8A, plotted at the same gain.
Figure 8B:
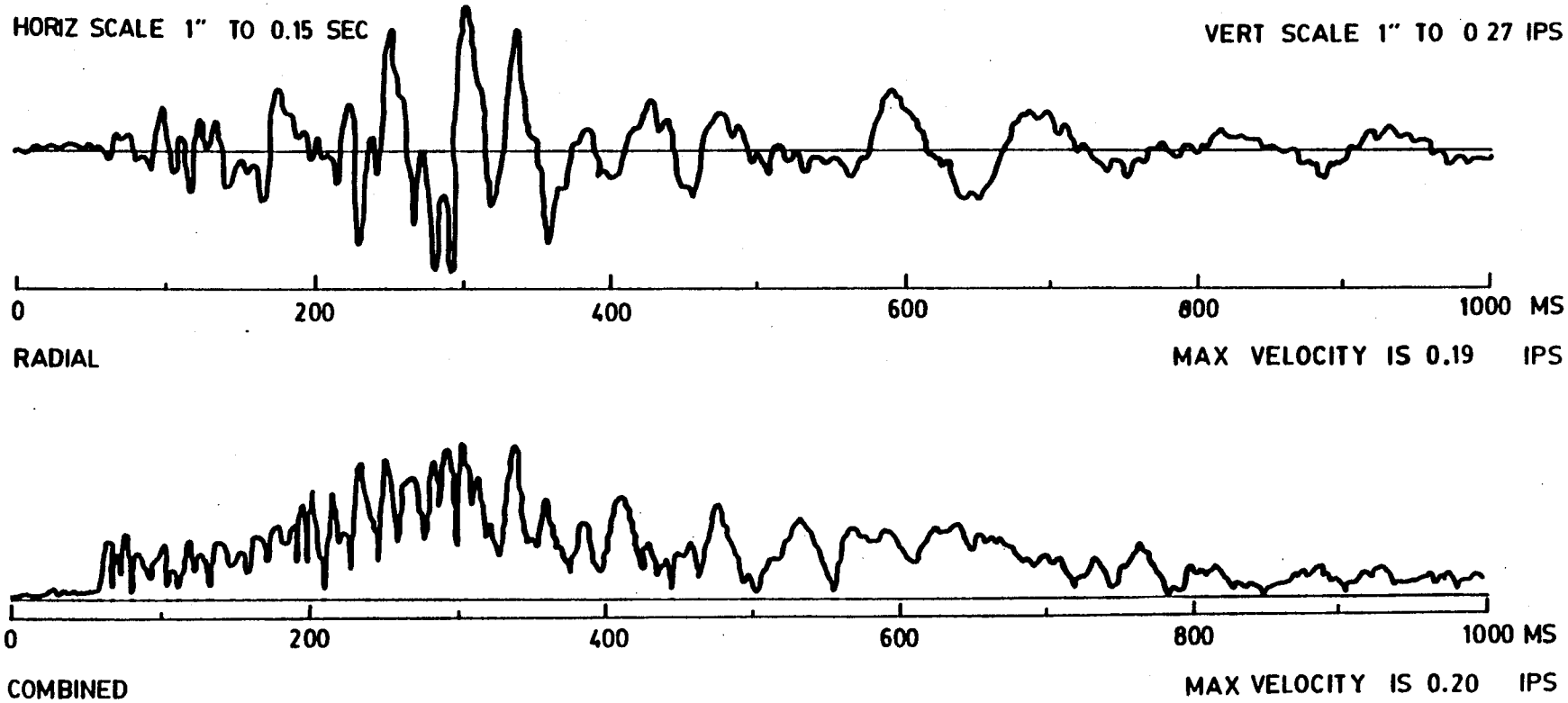

FIG. 8A shows a recording of the ground vibration produced by the 12-hole blast made in accordance with the invention, and FIG. 8B shows a corresponding recording for the conventional 12-hole blast made with ANFO. Both recordings were made with the same seismograph, in the same location and at the same range of 530 m from the adjacent blasts, and are displayed at the same gain. The displays, from top to bottom, are the transverse, vertical, and radial components of the ground velocity, and the vector sum of these three components, all as a function of time. The computer program used to analyze the vibration also displays the peak values of the velocities, in inches per second. The velocities in centimeters per second were as follows:

| | Total Mass of Explosive (kg) | Total Mass of Rock (metric) (tons) | Peak Ground Velocities (cm/sec) | | | |
|---|---|---|---|---|---|---|
| | | | Transverse | Vertical | Radial | Vector Sum |
| Blast made in accordance with the invention | 4790 | 12,200 | 0.13 | 0.064 | 0.13 | 0.15 |
| Comparative conventional blast made with ANFO | 3380 | 8,600 | 0.36 | 0.36 | 0.48 | 0.50 |
| Ratio: $\frac{\text{This invention}}{\text{ANFO}}$ | 1.42 | 1.42 | 0.36 | 0.18 | 0.27 | 0.30 |

As the table shows, the blast made in accordance with this invention used 1.42 times as much explosive and blasted 1.42 times as much rock as the conventional blast while requiring no more drilling. And the peak ground velocity produced was less than a third as great.

The fragmentation produced by the two blasts was estimated by computer analysis of photographs of the broken rock that had been loaded into trucks from predetermined regions of the two piles of broken rock produced by the blasts. Within experimental error, both blasts gave the same fragmentation, with 90% of the mass of broken rock having fragment diameters smaller than 0.23 m for both blasts.

EXAMPLE 2

Three different charges of semifluid blasting agent were tested. The composition and method of emplacement of the charges were all the same as described above for the charges of Example 1. They were loaded into vertical boreholes having a diameter of 160 mm which had been drilled into gabbro behind an existing quarry face. Each charge extended approximately 3 m above the position of its detonator and each was instrumented with a set of pin switches for measuring velocities of propagation in the length of charge above the detonator. Each charge was bottom-primed with two detonators, where each detonator comprised a blasting cap and a 0.454 lb. detonating charge of cast pentolite. These initiators were placed adjacent to each other near the bottom of the borehole so both would be detonated by the first one to detonate. Thereby, the effective size of the detonator was 0.91 kg of pentolite for each of the three charges. Charge 1A was the top charge in a hole containing three charges separated by beds of crushed stone and was one of the charges of a five-hole blast. Charge 2A was the top charge in a hole containing three charges and was one of the charges of a three-hole blast. Charge 3A was the only charge in a single-hole blast.

Figure 9:
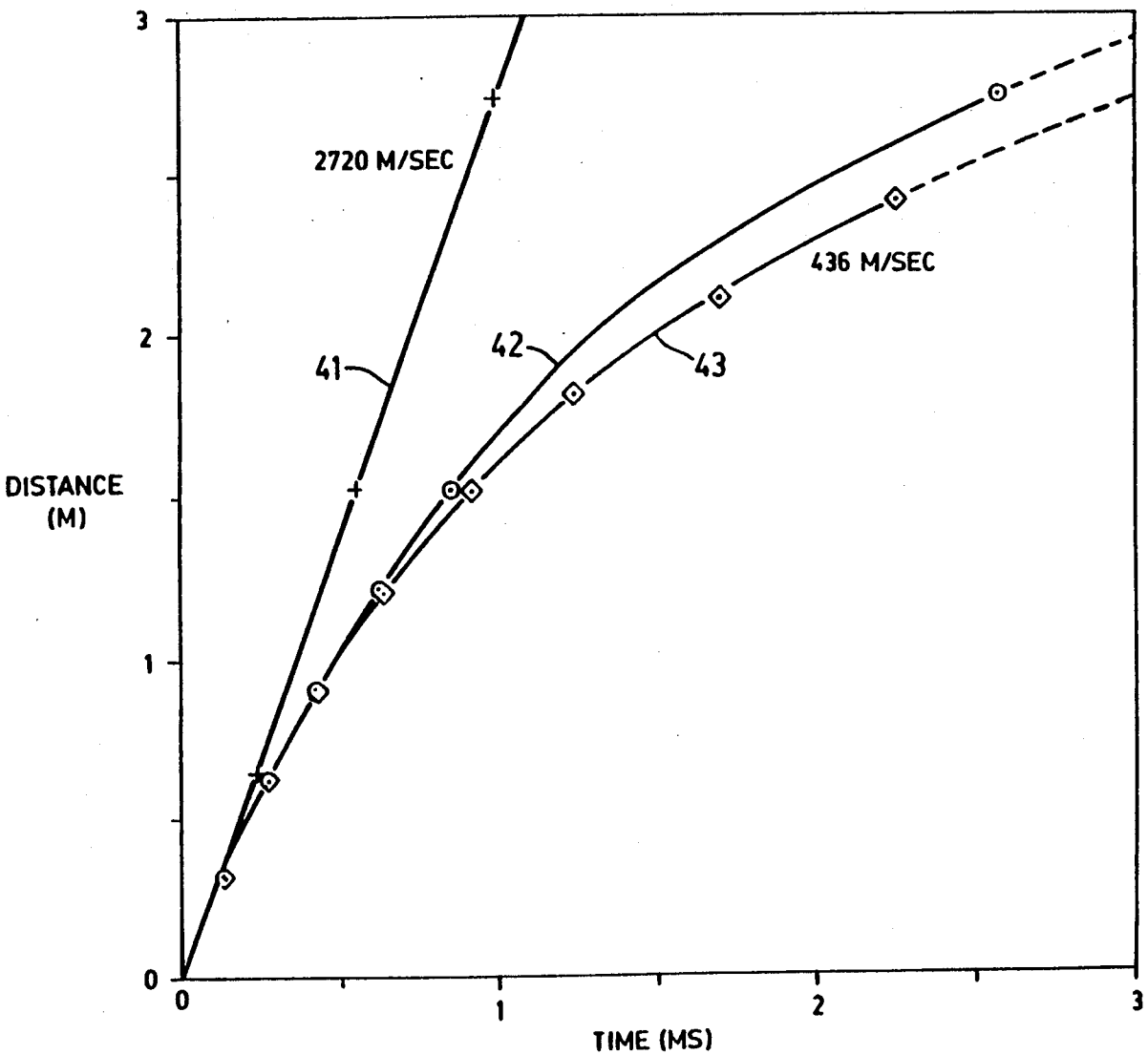
FIG. 9 is a graph of the location of pressure fronts vs. time, as recorded with pin switches, for exploding charges.

The distance from the detonator of each of the pin switches is plotted in FIG. 9 as a function of the time between firing the detonator and closure of the switch by arrival of the explosion front at the switch.

In FIG. 9 smooth curves 41, 42, and 43 are drawn through these points for each charge, respectively. The slopes of the curves are estimated rates of propagation for each of the explosions of charges 1A, 2A and 3A respectively.

The curves show that the initial rate of propagation was approximately 2720 m/sec for all three charges, and that this rate was maintained over the entire length of charge 1A. In both charges 2A and 3A, the rate of propagation slowed down to stable values of approximately 440 m/sec. If charge 1A had been long enough, its rate could be expected to finally stabilize at the lower rate as illustrated schematically in FIG. 2A. But the high values and wide variation in the rates of propagation in the vicinity of the detonator show that at the detonator the charges exploded in a manner outside the desired limits of the invention. In order to bring them inside the claimed limits, a reduction could be made in the size of the detonator or in the diameter of the borehole, or an increase could be made in the percentage of water in the more sensitive composition, or in the percentage of water injected, or a combination of two or more of these measures could be taken.

EXAMPLE 3

Charges of semifluid blasting agent topped off with charges of ANFO, were loaded into four boreholes having a diameter of 160 mm drilled into the granite of the quarry.

The charges of semifluid blasting agent had a more sensitive volume fraction and a less sensitive volume fraction The more sensitive volume fraction was composed of 40% of ammonium nitrate prills contained 6% No. 1 fuel oil and 60% of an emulsion having the following composition:

| Ingredient | Percent |
|---|---|
| Ammonium Nitrate (dissolved) | 70.0 |
| Water | 15.9 |
| No. 1 Fuel Oil | 0.8 |
| Chopped Aluminum Foil | 7.0 |
| Oleic Acid | 1.9 |
| Sodium Hydroxide | 0.5 |
| Glass Microballoons | 0.9 |

A detonator comprising an instantaneous electric blasting cap inserted in a 0.908 kg detonating charge of pentolite was emplaced in the bottom of each hole, and a set of pin switches were emplaced in the bottom 3 m of one of the holes.

The less sensitive volume fraction of the charge was formed and the charge was emplaced by the method described in Example 1, except that in this case the amount of water added to the annulus of the steam in the hose was 1% of the mass of the stream rather than 3%. A charge of ANFO was then emplaced on top of each of these charges of semifluid blasting agent. The holes were then stemmed with aggregate.

The detonators in the bottoms of the four holes were then shot simultaneously and the closures of the pin switches in the semifluid blasting agent in the instrumented hole were recorded.

Figure 10:
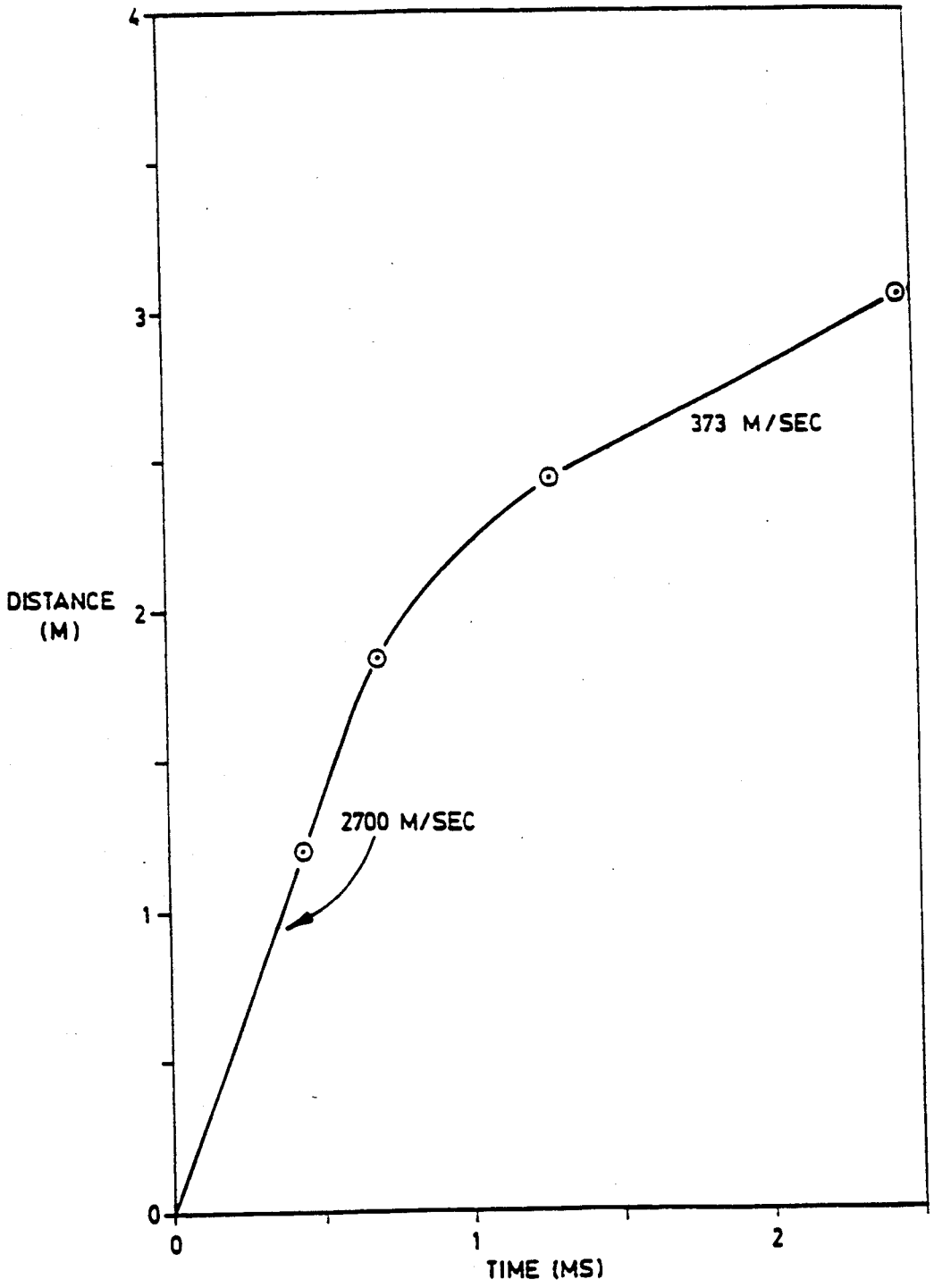
FIG. 10 is a similar plot for the explosion of a charge having a different composition.
Figure 5:
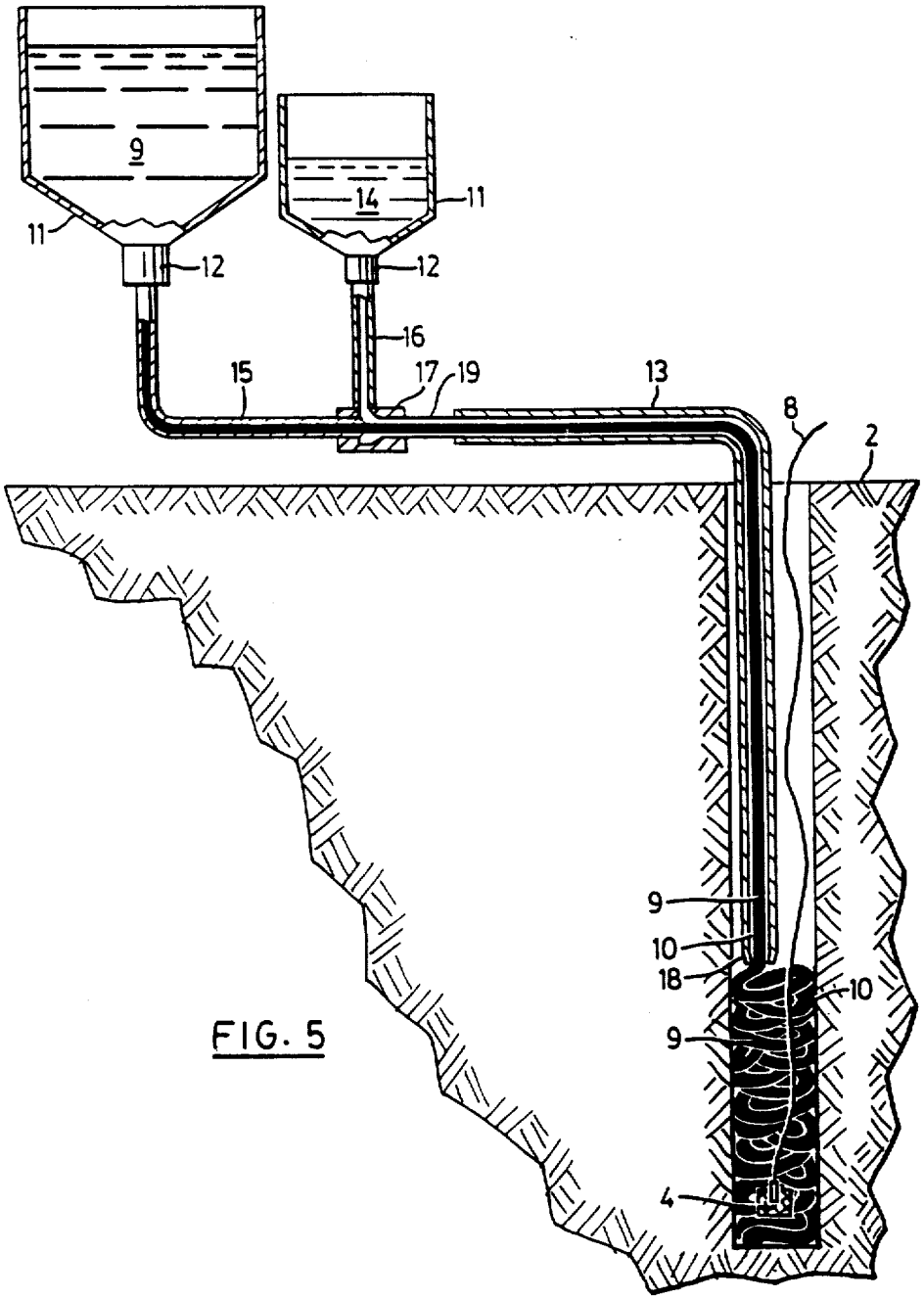

FIG. 10 shows a smooth curve drawn through a plot of the distances of the pin switches from the detonator as a function of the times at which they were closed by the explosion. The plot indicates that after propagating approximately 2 m at a velocity of approximately 2700 m/sec, the explosion front slowed down and stabilized at a velocity of approximately 370 m/sec.

This result shows that the composition of the charge and the diameter of the borehole were such as to allow a stable low velocity of propagation in accordance with the invention, but that the detonator including the pentolite detonating charge was so large that it initiated an explosion having a velocity of propagation that was initially greater than that preferred, but that after the explosive front travelled through the charge about two meters, the velocity of propagation achieved the preferred values.

An increase in the percentage of water or elimination of the glass microballoons, or an increase in the percentage of water injected, or a reduction in the size of the detonator or in the diameter of the hole, or a combination of these measures, would be expected to result in a velocity of propagation within the preferred range or greater than 200 and less than 1000 m/sec over a larger length of the charge.

EXAMPLE 4

A gas well 1225 m deep and 165 mm in diameter is drilled into a fracture zone in Devonian Shale Steel casing having an inside diameter of 152 mm is then cemented into the 0 to 970 m depth interval, leaving the hole uncased below a depth of 970 m. The well is then stimulated in the 1050 m to 1225 m depth interval as follows.

Semifluid blasting agent is prepared as described in Example 1, except that instead of being pumped into a borehole it is pumped into bags 130 mm in diameter and 750 mm long, constructed of polyethylene film with an outer layer of woven polypropylene. The 1055 m to 1225 m depth interval in the well is loaded with semifluid blasting agent of the invention by dropping bags filled with it down the well. The final top 5 m of the charge is then loaded by lowering the remaining 21 bags down the well on a release hook attached to a wireline, with time bombs emplaced in the bottom and middle bags. The time bombs each have a 0.454 kg detonating charge, with one being set to detonate in 12 hours from completion of loading and the other in 12.25 hours.

The charge is then stemmed with 75 m of clean 10 mm to 20 mm crushed stone and the well is cordoned off until after detection of ground motion resulting from detonation of the charge. The well is then cleaned out by drilling to a depth of 1225 m so as to remove the stemming and the rubble below it in the depth interval that contained the charge.

It will be appreciated by those skilled in the art that the foregoing description relates to preferred embodiments of the invention, and that various variations may still fall within the broad scope of the claims which follow. For example, the diameter of the hole, the sensitivity of the charge of blasting agent and the strength of the detonator are balanced so that under conditions of confinement provided by the walls of the holes and the stemming most or all of the charge explodes at low velocity rather than detonates at high velocity or fails to react. However, variation of one parameter can be accommodated by variation of one or both of the other parameters to achieve the desired result, as will be appreciated by those skilled in the art of this invention.

I claim:

1. An improved method of blasting comprising the steps of:

a) choosing a blasting agent of a predetermined sensitivity, having regard to the borehole diameter into which the blasting agent will be loaded;

b) choosing a detonator of a predetermined size having regard to the sensitivity of the blasting agent and the size of the borehole;

c) loading the blasting agent and detonator into the borehole to form an explosive charge;

d) closing the mouth of the borehole with a pressure resistant closure to confine the explosive charge;

e) detonating said detonation and thereby said explosive charge, and f) transforming said explosive charge into explosive products by consuming substantially all of said blasting agent along a reaction front which passes through said blasting agent with an average velocity of propagation of between 200 m/s and 1000 m/s for at least 30% of the total length of said blasting agent located in said borehole.

2. A method as claimed in claim 1 wherein said blasting agent's predetermined sensitivity and said detonator's predetermined size in combination result in a critical diameter for said explosive charge which is greater than the actual diameter of said borehole, wherein critical diameter means a diameter below which high order detonations will not propagate without dying out.

3. The method of improved blasting according to claim 1 wherein the step of closing the mouth of said borehole comprises filling a mouth of said borehole with solid materials for at least a length of 10 borehole diameters, said solid materials including stone, gravel, sand, drill cuttings, soil, grout, ice or dry ice.

4. The method of improved blasting according to claim 1 wherein the step of loading said blasting agent and said detonator into said borehole includes loading two detonators into separate parts of the charge, and timing the second detonator to detonate after a desired time from the time of detonation of the first one.

5. The method of improved blasting according to claim 4 wherein said detonator timed to detonate first is located within 25% of the length of the charge from an end of the charge.

6. The method of improved blasting according to claim 4 wherein said first detonator contains a combined mass of detonating explosives, including any associated booster, of between 0.2 kg and 0.9 kg and wherein said detonating explosives have velocities of propagation of at least 3000 m/sec.

7. The method of improved blasting according to claim 1 wherein said step of loading said blasting agent into said borehole includes pumping said blasting agent into said borehole.

8. The method of improved blasting according to claim 7 wherein said step of pumping further includes mixing a desensitizing agent into said composition to form an annular region of decreased sensitivity around a core of unchanged sensitivity.

9. The method of improved blasting according to claim 7 wherein said desensitizing agent is water, which is added at a controlled rate into the circumferential region at the discharge conduit of the pump.

10. The method of improved blasting according to claim 9 wherein said step of mixing is accomplished by using a hose having asperities on its internal surface.

11. The method of improved blasting according to claim 10 wherein said asperities are in the form of one or more spiral or circumferential ridges.

12. The method of improved blasting according to claim 10 wherein said mixing step comprises pumping the blasting agent through a hose having ridges which are 1% to 5% of the inside diameter of the hose in relief, and which have a spacing of 5% to 25% of the inside diameter of said base.

13. The method of improved blasting according to claim 9 wherein the water mixed into the blasting agent is thickened by the addition of up to 2% by weight of one or more thickening agents.

14. The method of improved blasting according to claim 8 wherein said core of normal sensitivity blasting agent comprises a premixed composition of 40.0%±5.0% prilled ammonium nitrate mixed with 60.0%±5.0% emulsion where the emulsion has an oil-rich external phase and a water-rich internal phase and contains 16.6%±1.7% water, 70.8%±7.1% dissolved ammonium nitrate, 3.8%±0.4% oleic acid, 7.7%±0.8% No. 2 fuel oil, and 1.1 ±0.1% sodium hydroxide, to give an overall composition that is 12.6%±2.3% water, 80.9%±8.1% ammonium nitrate, 2.2% ±0.2% oleic acid, 4.5%±0.4% No. 2 fuel oil, and 0.7%±0.1% sodium hydroxide, and wherein said annular region includes additionally 3.0%±2.5% by weight of the total composition of additional water coarsely mixed therewith.

15. A method of improved blasting according to claim 8 wherein said core of normal sensitivity blasting agent is a premixed composition of 40.0%±2.5% prilled ammonium nitrate mixed with 60.0%±2.5% emulsion where the emulsion has an oil rich external phase and a water rich internal phase and contains 16.6%±0.9% water, 70.8%±3.6% dissolved ammonium nitrate, ±0.05 sodiumhydroxide to give an overall composition that is 12.6%±1.4% water, 80.9%±4.1% ammonium nitrate, 2.2%±0.1 oleic acid, 4.5±0.2 No. 2 fuel oil, and 0.7±0.05% sodium hydroxide and where said annular region includes additionally 3.0±1.3 by weight of the total composition of additional water coarsly mixed therewith.

16. A method of selecting appropriate parameters for an explosion in a stemmed borehole having a velocity of propagation of between 200 m/sec and 1000 m/sec, said parameter including an appropriate composition of blasting agent, an appropriate borehole diameter and an appropriate detonator, said method comprising the steps of:

1)
   a) choosing a candidate borehole of a given diameter;
   b) placing instruments into said borehole to measure the average velocity of propagation of an explosion in said borehole;
   c) loading said borehole with a candidate blasting agent composition of a given sensitivity including the placement of a candidate detonating means;
   d) stemming said borehole;
   e) initiating an explosion; and
   f) measuring said average velocity of propagation of said explosion; and
2) if the measured velocity is greater than the desired value of 1000 m/s, then selecting a smaller borehole diameter, or a detonator means of smaller explosion mass or a blasting agent composition of a lower sensitivity, or a combination thereof, and if the measured velocity is less than the desired value of 200 m/s, or if part of the charge fails to explode, then selecting a larger borehole diameter, or a detonator means of larger explosive mass or a blasting agent composition of higher sensitivity, or a combination thereof, and
3) repeating the steps of (1) above until the measured velocity is within the range between 200 m/s and 1000 m/s.

17. A method according to claim 16 wherein step 1f) for measuring the average velocity of propagation of said explosion further comprises using an electrical circuit containing two or more open, pressure-activated switches placed at measured intervals along the charge in a line parallel to the direction of propagation and spanning a distance of at least 10 charge diameters, and using electronic circuitry to measure the successive times at which the switches are closed by the explosion front;

and wherein said step 1c) includes placing the detonator in the borehole beyond the wiring of said circuit.

18. A method according to claim 16 wherein step 1f) for measuring the average velocity of propagation of said explosion further comprises using two or more optic fibers, each with one end at a known position inside or adjacent to the loaded composition, and with the other end coupled to electronic circuitry outside the charge, wherein the detonator is placed in the charge beyond the fibers, and wherein each fiber end at the end of the charge is suddenly illuminated by arrival of the explosion front at each fiber end, and wherein the resultant pulse of light is transmitted along the fiber to electronic circuitry which detects it and measures the arrival time of the pulse of light.

19. A method according to claim 16 wherein step 1f) for measuring the average velocity of propagation of said explosion further comprises using a resistance wire and an adjacent conductor placed along the loaded composition in lines parallel to the direction of propagation and spanning a distance of at least 10 charge diameters, with the wires touching or inside the loaded explosive composition, and with the detonator placed in the composition beyond the wires, so that the resistance wire is shortened at the explosive front, and measurement of its time-dependent resistance thereby gives a continuous record of the position of the front versus time and thereby its velocity versus position.

20. A method according to claim 16 wherein step 1f) for measuring the average velocity of propagation of said explosion further comprises using a rapidly-pulsed radar, in which the radar signals are transmitted down to the explosion front and the radar echoes are returned through a crushable coaxial cable extending from the surface of the ground to the bottom of the borehole, and where the radar echoes are returned from the region of the cable that is being crushed by the pressure of the explosion front.

21. A method according to claim 16, wherein step 2 further comprises, for a candidate blasting agent composition having a uniform water content throughout, increasing the velocity of propagation by decreased the uniform percentage of water in the composition, or decreasing the velocity of propagation by increasing the uniform percentage of water in the composition.

22. A method according to claim 16, wherein, for a composition having a portion of higher water content and a portion of lower water content, the velocity of propagation of explosion is increased or decreased by decreasing or increasing the proportion of the charge having the higher water content.

23. A method according to claim 16, wherein, for a composition having a portion comprised of a composition of greater sensitivity for the initiation and propagation of detonation and a portion comprised of a composition of lesser sensitivity for the initiation and propagation of detonation, the velocity of propagation of explosion for the loaded composition is varied by varying the proportion of the composition having a greater sensitivity.

24. A method according to claim 16, wherein, for a loaded composition having a fraction comprised of a composition of greater sensitivity for the initiation and propagation of detonation and a fraction comprised of a composition of lesser sensitivity for the initiation and propagation of detonation, the velocity of propagation of explosion for the charge as a whole is increased or decreased by changing the composition of at least one of the fractions to increase or decrease the sensitivity for initiation and propagation of detonation of such fraction.

25. A method according to claim 16, where the sensitivity for initiation and propagation of detonation is increased or decreased by increasing or decreasing the percentage of water in at least a fraction of the loaded composition.

26. A method according to claim 16, wherein the sensitivity for initiation and propagation of detonation is increased or decreased by increasing the percentage of water in one fraction of the loaded composition or decreasing the percentage of water in another fraction of said composition or both.

* * * * *

UNITED STATES PATENT AND TRADEMARK OFFICE

CERTIFICATE OF CORRECTION

PATENT NO. : 5,099,763

DATED : March 31, 1992

INVENTOR(S) : David L. Coursen, Rufus E. Flinchum

It is certified that error appears in the above-identified patent and that said Letters Patent is hereby corrected as shown below:

Title page:

The name of the assignee should be --ETI Explosives Technologies International (Canada), Ltd.--

Column 11, line 2, the first instance of "17" should be followed by a semi-colon rather than a colon.

Column 11, line 4, change "inzo" to --into--.

Column 11, line 62, change "aid" to --acid--.

Claim 15, line 8, after "nitrate," insert --3.8 % ± 0.2 % oleic acid, 7.7 % ± 4 % No. 2 fuel oil and 1.1 % --.

Replace Figure 5 with attached Figure 5.

Signed and Sealed this

Seventeenth Day of August, 1993

Bruce Lehman

*Attest:*

BRUCE LEHMAN

*Attesting Officer*

*Commissioner of Patents and Trademarks*